US012385499B2

(12) United States Patent
Choi et al.

(10) Patent No.: US 12,385,499 B2
(45) Date of Patent: Aug. 12, 2025

(54) BLOWER

(71) Applicant: LG ELECTRONICS INC., Seoul (KR)

(72) Inventors: Jinwook Choi, Seoul (KR); Jaehyuk Jung, Seoul (KR); Juhyun Kim, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/373,562

(22) Filed: Sep. 27, 2023

(65) Prior Publication Data

US 2024/0151244 A1 May 9, 2024

(30) Foreign Application Priority Data

Nov. 4, 2022 (KR) ..... 10-2022-0146104

(51) Int. Cl.
*F04D 29/44* (2006.01)
*F04D 17/00* (2006.01)

(52) U.S. Cl.
CPC ..... *F04D 29/444* (2013.01); *F04D 17/00* (2013.01)

(58) Field of Classification Search
CPC ..... F04D 29/444; F04D 17/00; F04D 17/06; F04D 29/4253; F04D 29/602; F04D 25/08; F04D 29/263; F04D 29/281; F04D 29/325; F04D 29/403; F04D 29/4206; F04D 29/441; F04D 29/522; F04D 29/541; F05D 2210/12
See application file for complete search history.

(56) References Cited

U.S. PATENT DOCUMENTS

2021/0277911 A1* 9/2021 Jung ..... F04F 5/16

FOREIGN PATENT DOCUMENTS

| | | |
|---|---|---|
| CN | 107023884 | 8/2017 |
| CN | 111156623 | 5/2020 |
| CN | 212838644 U * | 3/2021 |

* cited by examiner

*Primary Examiner* — Courtney D Heinle
*Assistant Examiner* — Eric A Lange
(74) *Attorney, Agent, or Firm* — KED & ASSOCIATES

(57) ABSTRACT

A blower including a case; a fan; and a diffuser that is disposed downstream of the fan and guides air, discharged from the fan, toward discharge ports. The diffuser includes an outer wall; an inner wall spaced apart inwardly from the outer wall so that an air passage is formed therebetween; and a plurality of vanes that extends radially between the outer wall and the inner wall and divides the air passage into a plurality of unit passages. The outer wall and the inner wall are formed to have areas with different radial separation distances between the outer wall and the inner wall, such that in an area of the air passage of the diffuser in which air is discharged to a portion having a high flow resistance in the blower, the radial separation distance increases to widen the air passage, thereby compensating for asymmetry of the passage inside of the blower, allowing a uniform volume of air to reach an entire area of the discharge ports, and improving performance of the blower.

20 Claims, 17 Drawing Sheets

BLOWER

CROSS-REFERENCE TO RELATED PATENT APPLICATIONS

This application claims priority to Korean Patent Application No. 10-2022-0146104, filed Nov. 4, 2022, whose entire disclosures are hereby incorporated by reference.

BACKGROUND OF THE INVENTION

1. Field of the Invention

The present disclosure relates to a blower for discharging air using the Coanda effect, and more particularly to a blower including a diffuser for guiding a flow.

2. Description of the Related Art

A blower, having a suction port and a discharge port and including a blower fan therein, is a device for discharging air, drawn in through the suction port, to the outside through the discharge port. In this case, it is known that the blower should be provided with an appropriate interior space (or an air passage inside the blower), since the space is directly related to air-blowing performance of the blower itself as well as energy efficiency (degree of vibration and noise, power efficiency, etc.) of the blower.

Generally, the blower includes a diffuser located downstream of the blower fan so as to allow air, discharged from the blower fan, to smoothly flow to a discharge side. The diffuser is a device for increasing static pressure at the expense of a fluid speed, and for guiding a fluid in a desired direction through a vane which is a flow resistor designed with intention. That is, the diffuser in the blower is a device for allowing air, discharged from the blower fan, to pass through the vane to flow to the discharge side.

In an existing blower disclosed in Chinese patent publication Nos. 111156623 A and 107023884 A, if the aforementioned diffuser is located downstream of the fan, an air passage formed in the diffuser is uniformly manufactured, such that the air passage has a ring shape arranged in a concentric circle around a rotation axis of the fan.

However, in many cases, a position of an interior space of the blower may not be radially symmetric about the rotation axis of the fan. For example, an asymmetric structure may be disposed only on one side of the interior space of the blower, or if the discharge port of the blower may have a tower shape instead of the ring shape. As the diffuser is uniformly formed in the ring shape even when the interior space is asymmetric about the rotation axis, the existing blower has a low flow efficiency, thereby degrading the air blowing performance of the blower.

In addition, a diffuser, which is integrally injection molded, is generally used in the existing blower. In this case, even when there is a structural change by upgrading internal components of the blower or further installing new components such as a heater, lighting fixture, etc., the shape of the diffuser may not be appropriately adjusted according to the changed structure.

Further, the existing blower has a structure in that the components are generally stacked from bottom to top with the diffuser disposed therebetween, such that a load at the top of the diffuser is concentrated on the diffuser, but an outer circumference and an inner circumference of the existing blower are merely connected by a thin vane, without a separate reinforcing structure for sharing the load, thereby degrading durability of the diffuser.

SUMMARY OF THE INVENTION

It is an objective of the present disclosure to solve the above and other problems.

It is another objective of the present disclosure to provide a blower with an improved air-blowing performance by providing a diffuser in a shape corresponding to a shape of a passage inside the blower.

It is yet another objective of the present disclosure to provide a blower capable of guiding a flow as well as safely supporting load even in a structure in which a load at the top is concentrated on the diffuser.

It is yet another objective of the present disclosure to provide a blower having excellent air-blowing performance by simply modifying an existing diffuser.

It is yet another objective of the present disclosure to provide a blower including a diffuser capable of being adjusted according to a structure when the structure is further installed later during use of the blower, such that excellent air-blowing performance of the blower may be maintained even when a passage inside the blower is changed.

The objectives of the present disclosure are not limited to the aforementioned objectives and other objectives not described herein will be clearly understood by those skilled in the art from the following description.

A blower according to an embodiment of the present disclosure includes: a case; a fan; and a diffuser disposed downstream of the fan and guiding air, discharged from the fan, toward the discharge ports.

The diffuser according to an embodiment of the present disclosure may include: an outer wall having a circumference; an inner wall spaced apart inwardly from the outer wall so that an air passage S, through which the air discharged from the fan flows, is formed therebetween.

The diffuser according to an embodiment of the present disclosure may include: a plurality of vanes extending radially between the outer wall and the inner wall and dividing the air passage S into a plurality of unit passages.

In this case, the outer wall and the inner wall may be formed to have areas with different radial separation distances D between the outer wall and the inner wall.

Accordingly, in an area of the air passage of the diffuser in which air is discharged to a portion having a high flow resistance in the blower, the radial separation distance D between the outer wall and the inner wall increases to enlarge the air passage S, thereby compensating for the asymmetry of the passage inside the blower, allowing a uniform volume of air to reach the entire area of the discharge ports, and improving the performance of the blower.

The case of the blower according to an embodiment of the present disclosure may include a lower case, a middle case, and/or an upper case which are sequentially stacked. The lower case may have the suction port formed therein, and the fan and the diffuser disposed therein. The upper case may have the discharge ports formed therein, may be disposed over the lower case, and may have a discharge passage O disposed therein through which the air flows toward the discharge ports. The middle case may be disposed between the lower case and the upper case, and may have an intermediate passage M to allow the air passage S to communicate with the discharge passage O.

The blower according to an embodiment of the present disclosure may further include a penetrating member having at least a portion penetrating into the middle case and disposed in the intermediate passage M. In this case, the separation distance D in a first area S1 may be larger than in an area adjacent to the first area S1 in the air passage S of the diffuser, the first area S1 being defined as a projected area in which the penetrating member is projected to the air passage S of the diffuser.

Accordingly, as the separation distance D in the first area S1 is larger than in the adjacent area, a volume of air per unit time passing through the first area S1 relatively increases, such that even with a local flow resistance caused by the penetrating member 362, a uniform volume of air may reach the entire area of the discharge ports, thereby improving the performance of the blower.

The upper case according to an embodiment of the present disclosure may include: a first tower and a second tower, each having a discharge passage O and the discharge port and communicating with the middle case, wherein the separation distance D in at least a portion of a second area S2 may be formed to be larger than in an area adjacent to the second area in the air passage S of the diffuser, the second area S2 being defined as an area in which the first discharge passage O1 and the second discharge passage O2 are projected to the air passage S.

By adjusting the discharge passages, connected to each of the plurality of discharge ports, according to a passage width of the diffuser, the air may flow directly and straight toward the discharge ports, thereby increasing the proportion of air reaching the discharge ports and reducing the flow resistance in the blower. Further, the volume of air may be distributed uniformly to each of the plurality of discharge ports, such that the performance of the blower may be improved.

In the blower according to an embodiment of the present disclosure, the first tower and the second tower are laterally spaced apart from each other, such that a space may be formed therebetween. In this case, the blower may further include: a bridge surface connecting lower ends of side walls of the first tower and the second tower which face each other with respect to the space; and a supporter having a lower portion connected to an upper end of the inner wall and an upper portion connected to a lower side of the bridge surface, so as to transfer load from the bridge surface to the inner wall.

In this case, in order to prevent the load at the top of the blower from being concentrated on the inner wall, the plurality of vanes may have radially inner ends connected to the inner wall and radially outer ends connected to the outer wall.

Accordingly, in a structure in which it is required to stably transfer the load at the top of the blower to the bottom of the blower, particularly in the blower having the shape of twin towers which are spaced apart from each other, the inner wall and the outer wall are connected by the vanes of the diffuser for guiding an air flow while transferring the load from the top of the blower 1 to the inner wall 344 of the diffuser, thereby distributing the burden of load of the inner wall to the outer wall, and improving structural rigidity of the diffuser.

In the diffuser of the blower according to an embodiment of the present disclosure, the air passage S may include an extended area Se in which the separation distance D is greater than in other adjacent areas, wherein a recessed portion, which is recessed radially inward, may be formed in the inner wall of the extension area Se.

Accordingly, compared to the case where the outer wall is bent outward to widen the passage of the diffuser, the inner wall is bent inward, thereby simply widening the passage of the diffuser while maintaining a total volume of the diffuser, such that an air volume of the blower may increase.

The diffuser of the blower according to an embodiment of the present disclosure may further include a sub-column disposed within the inner wall, disposed on a same circumference as the recessed portion with respect to a center of the inner wall, and having an upper end connected to the lower portion of the supporter.

Accordingly, the sub-column disposed within the inner wall and the recessed portion of the inner wall may support the load at the top of the blower on the same circumference, thereby preventing damage to the inner wall when the load is concentrated on the recessed portion of the inner wall, and improving structural stability of the blower.

According to an embodiment of the present disclosure, the plurality of vanes may be equally spaced apart around a circumference of the inner wall or a circumference of the outer wall. In addition, according to another embodiment of the present disclosure, the separation distance between adjacent vanes of the plurality of vanes may be larger in the extended area Se than in other adjacent areas.

While the vanes may serve to guide a flow in an upward direction, the vanes may also locally increase flow resistance. Thus, an air volume in a specific area may be improved by reducing the number of vanes in an area in which it is required to secure the air volume.

According to an embodiment of the present disclosure, a plurality of grooves may be formed circumferentially in an inner surface of the outer wall and an outer surface of the inner wall. Separation distances between adjacent grooves of the plurality of grooves may be equally spaced apart. The plurality of vanes may be press-fitted into predetermined grooves of the plurality of grooves, to be fastened thereto.

A separation distance between the vanes may be adjusted simply by employing a groove-fitting method and allowing the vanes to be selectively fastened to grooves at desired positions, among a plurality of predetermined grooves. For example, even when an internal structure of the blower is changed by a user's adding an option and the like, it is possible to simply adjust the blower according to the changed structure.

In the diffuser of the blower according to an embodiment of the present disclosure, a bent portion may be a curved surface that is convex inward. Accordingly, as the bent portion is formed as a curved surface that is convex inward, the width of the air passage S may further increase compared to the case where the bent portion is simply formed as a planar surface.

Other detailed matters of the exemplary embodiments are included in the detailed description and the drawings.

Effects of the Invention

According to the present disclosure, the air passage S is widened in a predetermined area of the diffuser, thereby compensating for the asymmetry (e.g., non-annular shape of the discharge port of the blower or the penetrating member disposed downstream of the diffuser) of the passage inside the blower, allowing a uniform volume of air to reach the entire area of the discharge ports, and improving blowing performance and noise performance of the blower.

According to the present disclosure, in a structure in which it is required to stably transfer the load at the top of the blower to the bottom of the blower (particularly in the blower having the shape of twin towers which are spaced apart from each other), the inner wall and the outer wall are connected by the vanes of the diffuser for guiding an air flow while transferring the load from the top of the blower to the inner wall of the diffuser, thereby distributing the burden of load of the inner wall to the outer wall, and improving structural rigidity of the diffuser.

According to the present disclosure, compared to the case where the outer wall is bent outward to widen the passage of the diffuser, the inner wall is bent inward, thereby simply widening the passage of the diffuser while maintaining a total volume of the diffuser, such that an air volume of the blower may increase.

According to the present disclosure, the sub-column disposed within the inner wall and the recessed portion of the inner wall may support the load at the top of the blower on the same circumference, thereby preventing damage to the inner wall when the load is concentrated on the recessed portion of the inner wall, and improving structural stability of the blower.

According to the present disclosure, an air volume in a specific area may be improved by reducing the number of vanes in an area in which it is required to secure the air volume.

According to the present disclosure, a separation distance between the vanes may be adjusted simply by employing a groove-fitting method and allowing the vanes to be selectively fastened to grooves at desired positions, among a plurality of predetermined grooves. Accordingly, even when an internal structure of the blower is changed by a user's adding an option and the like, it is possible to simply adjust the blower according to the changed structure.

According to the present disclosure, as the bent portion is formed as a curved surface that is convex inward, the width of the air passage S may further increase compared to the case where the bent portion is simply formed as a planar surface.

The effects of the present disclosure are not limited to the aforesaid, and other effects not described herein will be clearly understood by those skilled in the art from the following description of the appended claims.

DETAILED DESCRIPTION OF THE PREFERRED EMBODIMENTS

Figure 1:
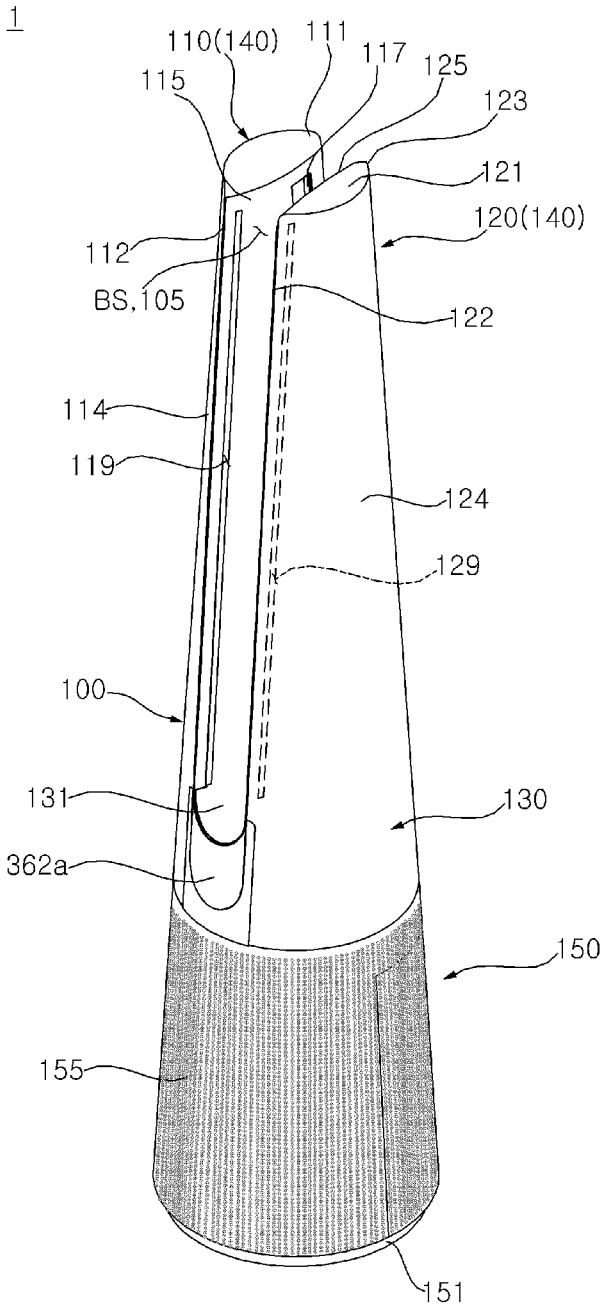
FIG. 1 is a perspective view of a blower according to an embodiment of the present disclosure.

Advantages and features of the present disclosure and methods of accomplishing the same will be more clearly understood from exemplary embodiments described below with reference to the accompanying drawings. However, the present disclosure is not limited to the following embodiments but may be implemented in various different forms. The embodiments are provided only to complete disclosure of the present disclosure and to fully provide a person having ordinary skill in the art to which the present disclosure pertains with the category of the present disclosure, and the present disclosure is only defined by the scope of the appended claims. Wherever possible, like reference numerals generally denote like elements through the specification.

Hereinafter, unless otherwise specified, the terms "upstream" and "downstream" may refer to upstream and downstream sides of an airflow in a blower 1. The following description may be based on the premise that a suction port 155, a fan 320, a diffuser 340, and discharge ports 117 and 127 are arranged from bottom to top, unless otherwise specified. However, this is merely for convenience of explanation, and the gist of the present disclosure should be understood based on whether an airflow direction is an upstream direction or a downstream direction, and the technical idea of the present disclosure should not be construed as being limited by left, right, up, and down directions thereof. For example, if the suction port 155 is disposed above the diffuser 340, and the discharge ports 117 and 127 are disposed below the diffuser 340, a passage width of the diffuser 340 may be formed in consideration of a lower space of the diffuser 340.

The following description will be given based on the premise that an inner wall 344 of the diffuser 340 functions as a motor housing that accommodates a fan motor 310. However, the technical idea of the present disclosure is not limited thereto, and it should be understood that the gist of the present disclosure lies in technical features related to the airflow of the diffuser 340. For example, the fan motor 310 may be coupled to an upstream end of the fan 320, and the diffuser 340 may be disposed at a downstream end of the fan 320.

A blower 1 according to an embodiment of the present disclosure includes: a case 100; a fan 320; and a diffuser 340 guiding air, wherein the diffuser 340 includes: an inner wall 344 and an outer wall 342 spaced apart from each other and each having a circumference, with an air passage S formed therebetween; and a plurality of vanes 348 extending radially between the outer wall 342 and the inner wall 344 and dividing the air passage S into a plurality of unit passages ss, wherein the outer wall 342 and the inner wall 344 are formed to have areas with different radial separation distances D between the outer wall 342 and the inner wall 344.

Hereinafter, the overall configuration of the blower 1 and the diffuser 340 according to an embodiment of the present disclosure will be described with reference to FIGS. 1, 5 to 7, and 14 to 19. First, the overall configuration of the blower 1 will be described below.

The case 100 may form the exterior of the blower 1. The case 100 has a suction port 155 and discharge ports 117 and 127.

The case 100 may include a lower case, a middle case 130, and an upper case 140.

The suction port 155 may be formed in the lower case. The suction port 155 may be open at the circumference of the lower case.

The fan 320 and the diffuser 340 may be disposed in the lower case. With respect to an air flow, the suction port 155, the fan 320, and the diffuser 340 may be sequentially disposed in the lower case. The diffuser 340 may serve to reduce a radial component and reinforce an upward component in the air flow. The diffuser 340 may be disposed at a lowermost downstream end of the lower case. The lowermost downstream end of the diffuser 340 may be a downstream end of the lower case (see FIGS. 5 to 7).

The discharge ports 117 and 127 may be formed in the upper case 140. The discharge ports 117 and 127 may be open at the circumference of the upper case 140. Alternatively, as will be described later, the discharge ports 117 and 127 may be formed in the open portion of the upper case 140, such that the discharge ports 117 and 127 may be formed in a unique shape.

The upper case 140 may be disposed over the lower case. A discharge passage O, through which air flows toward the discharge ports 117 and 127, may be formed in the upper case 140. The discharge passage O may be understood as an inner space of the upper case 140.

The middle case 130 may be disposed between the lower case and the upper case 140. The middle case 130 may include an intermediate passage M allowing the air passage S, which will be described later, to communicate with the discharge passage O. The intermediate passage M may be understood as an inner space of the middle case 130.

A downstream end of the lower case may be a downstream end of the air passage S of the diffuser 340. An upstream end of the intermediate passage M may communicate with the air passage S. A downstream end of the intermediate passage M may communicate with the discharge passage O. The air passage S, the intermediate passage M, and the discharge passage O may form a continuous space.

A lower end of the middle case 130 may be connected to an upper end of the lower case. An upper end of the middle case 130 may be connected to a lower end of the upper case 140. The lower case, the middle case 130, and the upper case 140 may form a continuous surface.

Air discharged from the diffuser 340 may pass through the intermediate passage M to be supplied into the discharge passage O.

Hereafter, the middle case 130 may be used interchangeably with and/or referred to as a "tower base 130." The tower base 130 may connect lower portions of the first tower 110 and the second tower 120.

The fan 320 may be disposed in the case 100. The fan 320 may draw in outside air through the suction port 155, and then discharges the air toward the discharge ports 117 and 127. Any type of fan may be used depending on an internal structure of the blower 1. It is preferred to use a mixed flow fan 320 to reduce vibrations and noise in the blower 1.

Hereinafter, the diffuser will be described particularly with reference to FIGS. 5 to 7 and 13 to 19.

The diffuser 340 is disposed downstream of the fan 320 and guides the air, discharged from the fan 320, toward the discharge ports 117 and 127.

The diffuser 340 includes: an outer wall 342 having a circumference; an inner wall 344 spaced apart inwardly from the outer wall 342 so that the air passage S, through which the air discharged from the fan 320 flows, is formed therebetween; and a plurality of vanes 348 extending radially between the outer wall 342 and the inner wall 344 and dividing the air passage S into a plurality of unit passages ss.

The outer wall 342 may have a circumference with both ends that are open. The inner wall 344 may have a circumference that is narrower in width than the outer wall 342 and may be disposed within the outer wall 342. The inner wall 344 may face the outer wall 342. The air passage S may be formed in a space between the inner wall 344 and the outer wall 342 that face each other. The inner wall 344 and the outer wall 342 may be substantially parallel to each other.

The outer wall 342 may be elongated toward an upstream side in an air flow direction and may accommodate the fan 320 therein. The inner wall 344 is shorter than the outer wall 342, and the fan 320 may be disposed on an upstream side of the inner wall 344. Each of the fan 320 and the inner wall 344 may face the outer wall 342.

The inner wall 344 may accommodate a fan motor 310 therein which provides a driving force to the fan 320. The fan motor 310 accommodated in the inner wall 344 may be coupled to the fan 320 via a motor shaft 312 that passes through one side of the inner wall 344. The motor shaft 312 of the fan motor 310 may be coupled to a rotating shaft of the fan 320. As the fan motor 310 is accommodated in the inner wall 344, space efficiency of the blower 1 may be improved. In order to accommodate the fan motor 310 therein and to support a lower surface of the fan motor 310 from below, the inner wall 344 may further include a sub-part **344*b* that covers a lower part of the fan motor 310 (see FIG. 13). The sub-part 344*b* may be formed in a cone shape having a cross-section that decreases toward the fan 320. The sub-part 344*b* may have an open lower portion, through which the motor shaft 312 of the fan motor 310 may pass. The motor shaft 312, having passed through the open portion of the sub-part 344*b*, may be coupled to the rotating shaft of the fan 320. In order to distinguish from the sub-part 344*b* of the inner wall 344, a portion of the inner wall 344 that faces the outer wall 342 may be referred to as a main part 344*a***.

The sub-part **344*b* may extend radially inward from a lower end of the main part 344*a* and obliquely toward the fan 320. At a portion where the fan motor 310 and the fan 320 are close enough to be connected to each other by the motor shaft 312, the sub-part 344*b* may extend radially inwardly and horizontally. A central portion of the horizontally extending portion may be open such that the motor shaft 312** may pass therethrough.

However, the technical idea of the present disclosure is not limited thereto, and a motor housing accommodating the fan motor 310 and the inner wall 344 may also be provided separately.

An inlet (or upstream end) of the air passage S of the diffuser 340 may be connected to a discharge portion of the fan 320, thereby allowing the air discharged from the fan 320 to be supplied to the diffuser 340. An outlet (or downstream end) of the air passage S of the diffuser 340 may be connected to the intermediate passage M of the tower base 130, thereby allowing the air discharged from the diffuser 340 to be supplied to the tower base 130.

The air passage S may be understood as a space between the outer wall 342 and the inner wall 344. The air passage S may have a substantially ring shape. The air discharged from the fan 320 may flow through the air passage S to be discharged from the diffuser 340. The air passage S may be simply abbreviated to a "passage of the diffuser 340" or a "passage formed by the diffuser 340."

In this specification, a radial direction refers to not only a linear direction extending from the center of a circle to the circumference thereof, but also a linear direction extending from the center to a periphery of any shape as long as the center and periphery of the shape may be defined. That is, the outer wall 342 and/or the inner wall 344 are not necessarily formed in a circular shape.

The air passage S may be divided into a plurality of unit passages ss by the plurality of vanes 348. The air passage S may be understood as a sum of the plurality of unit passages ss. The vanes 348 may be elongated radially to be disposed between the outer wall 342 and the inner wall 344. The plurality of vanes 348 may be spaced apart from each other to be arranged along the circumference of the inner wall 344 or the circumference of the outer wall 342. The vanes 348 of the diffuser 340 may guide the air discharged from the blower fan 320 in an upward direction, and may prevent the air, having passed through the diffuser 340, from turning (i.e., backflow) toward the blower fan 320.

The outer wall 342 and the inner wall 344, which are spaced apart from each other, may define a radial separation distance D therebetween. The separation distance D at a specific portion may be equal to a radial length of the vane 348 disposed at the corresponding portion. In a general blower diffuser 340, each of the outer wall 342 and the inner wall 344 is formed in a cylindrical shape, and thus the separation distance D is the same for all the radii of rotation.

However, according to an embodiment of the present disclosure, the outer wall 342 and the inner wall 344 are formed to have areas with different radial separation distances D between the outer wall 342 and the inner wall 344.

Figure 13:
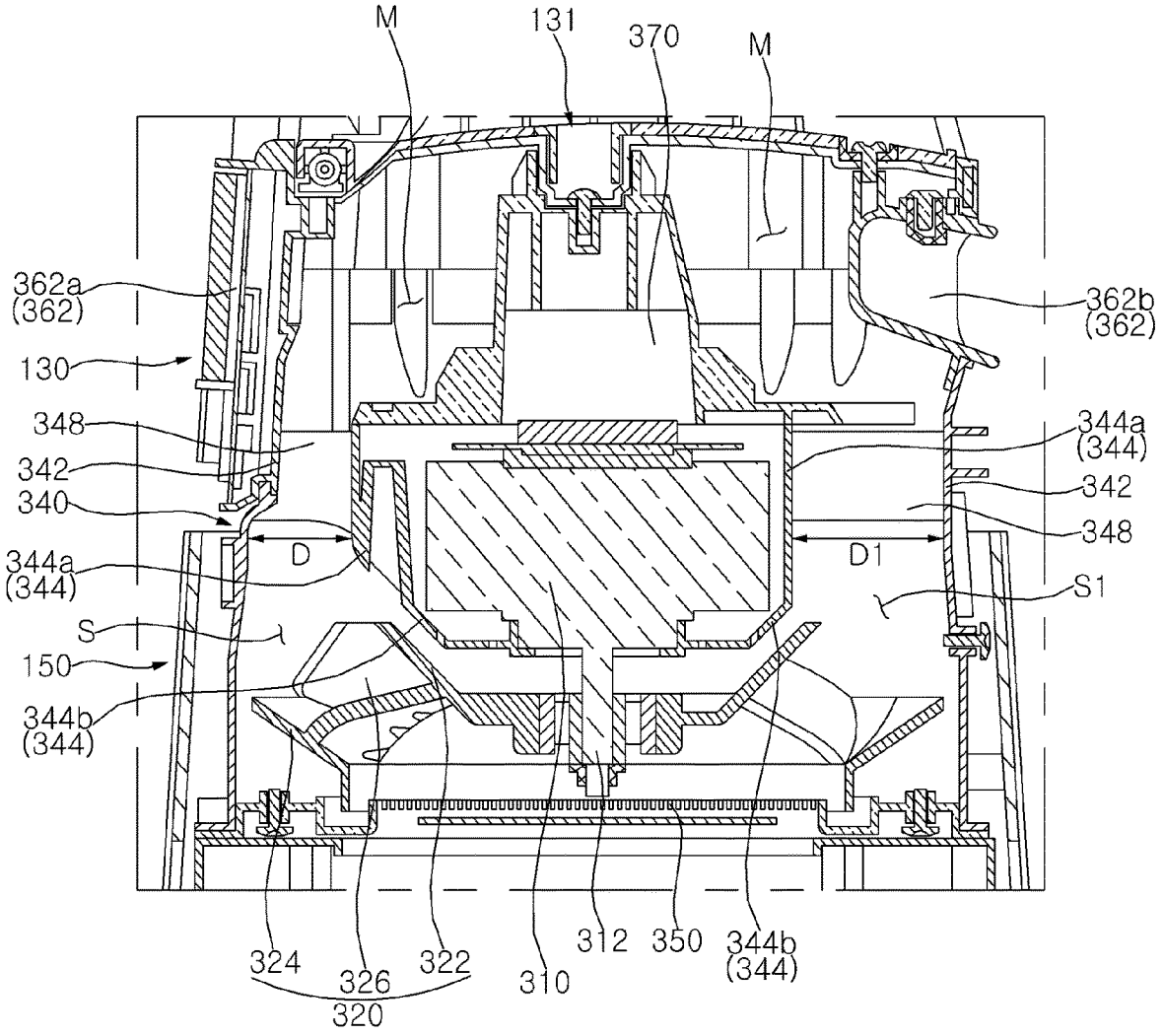
FIG. 13 is an enlarged view of portion TA of FIG. 5.

By providing different separation distances D of the diffuser 340 in a predetermined area, parameters, such as air volume, pressure, etc., of air passing through the diffuser 340 may be adjusted differentially. For example, as illustrated in FIG. 13, the air passage S may include a first area S1 with a first separation distance D1 which is a relatively long separation distance D, and another area (left space of the inner wall 344 in FIG. 13) with the separation distance D which is shorter than the first separation distance D1.

Accordingly, for example, in an area of the air passage of the diffuser 340 in which air is discharged to a portion having a high flow resistance in the blower 1, the radial separation distance D between the outer wall 342 and the inner wall 344 increases to widen the air passage S, thereby compensating for the asymmetry of the passage inside the blower, allowing a uniform volume of air to reach the entire area of the discharge ports 117 and 127, and improving the performance of the blower 1.

A portion of the outer wall 342 and/or the inner wall 344 may be bent radially outward or inward, so that the outer wall 342 and/or the inner wall 344 may have areas with different radial separation distances D between the outer wall 342 and the inner wall 344.

The outer wall 342 may form the exterior of the diffuser 340, in which the diffuser 340 is required to be accommodated in a limited internal space of the blower 1, such that the outer wall 342 may be formed in a shape that is in inner contact with the case 100 of the blower 1. Accordingly, it may be preferred that for adjusting the separation distance D, it may be more efficient to bend the inner wall 344 in a radially inward direction than in a radially outward direction. A method of adjusting the separation distance D will be described in detail later.

Hereinafter, the "separation distance D" may directly refer to a radial distance between the outer wall 342 and the inner wall 344. The separation distance D may be understood as a width of the passage formed by the diffuser 340. Hereinafter, the "width of the passage of the diffuser 340" may be used interchangeably with the "separation distance D between the outer wall 342 and the inner wall 344" to indicate the same meaning.

The blower 1 may further include a penetrating member 362 having at least a portion penetrating into the middle case 130 to be disposed on the intermediate passage M (see FIGS. 5 to 7 and 13).

The penetrating member 362 may be a structure for providing a specific function to the blower 1. The penetrating member 362 may occupy a portion of the intermediate passage M. The flow of air in the intermediate passage M may be disturbed by the penetrating member 362. The penetrating member 362 may be a resistance to the flow in the intermediate passage M. In order to compensate for the flow resistance in the intermediate passage M, the separation distance D of the passage width of the diffuser 340 may be adjusted as will be described later.

For example, the penetrating member 362 may be a handle 362*b* that facilitates movement of the blower 1 by allowing a user to put their hands into a recessed portion. The handle 362*b* may be recessed inward from an outer surface of the middle case 130, and a side opposite a direction of the recessed portion may be open to communicate with an external space.

Alternatively, the penetrating member 326 may be, for example, a display unit 362*a* including a display for visually displaying information about the blower 1 to a user, and a display-related component. The display may be disposed on an outer surface of the middle case 130 to be exposed to the outside. The display-related component may be a display electronic circuit board (PCR) that penetrates from the display into the middle case 130 and is electrically connected to the display.

There may be a plurality of penetrating members 362. For example, the display unit 362*a* may be disposed on a front surface of the middle case 130, and the handle 362*b* may be disposed on a rear surface of the middle case 130.

Figure 14:
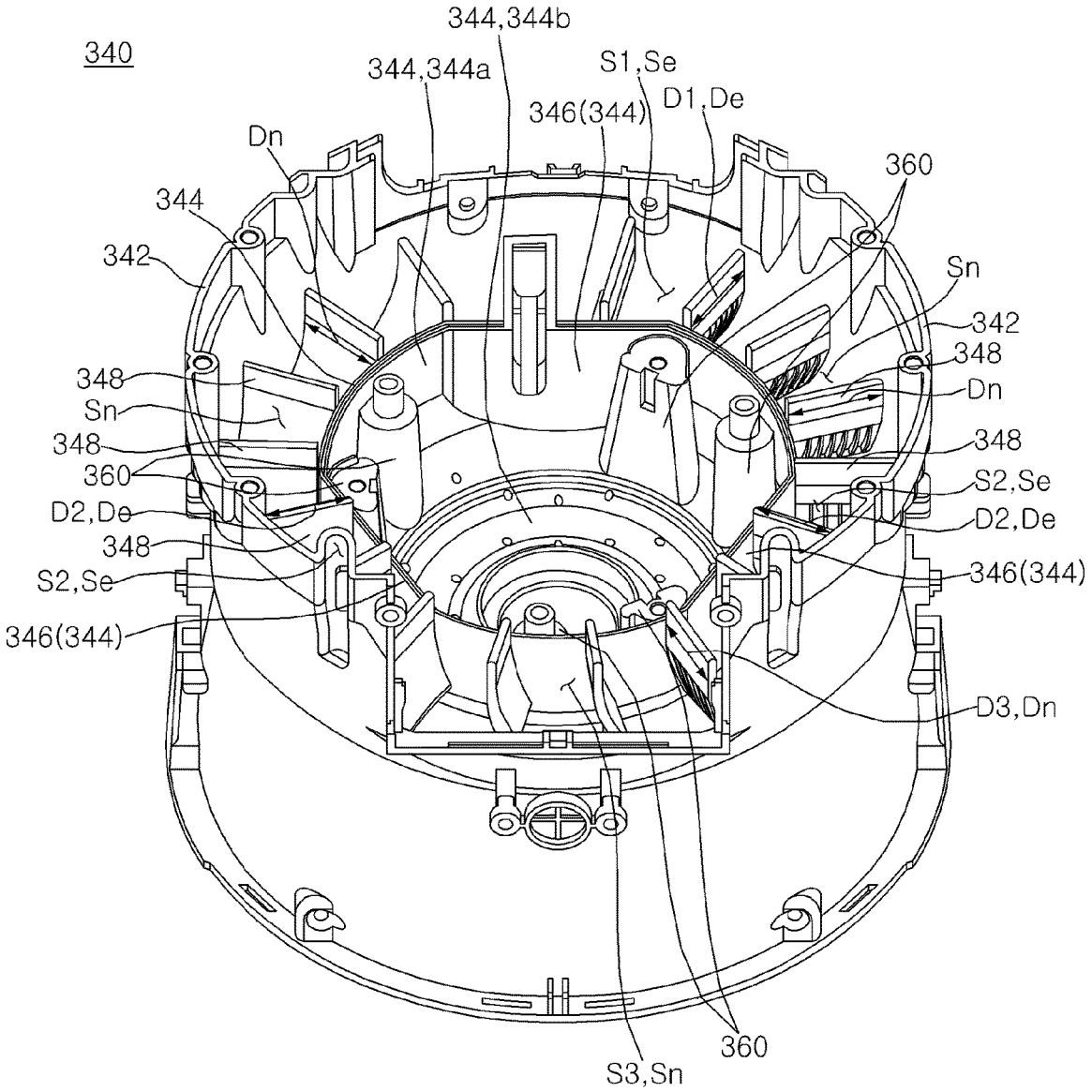
FIG. 14 is a perspective view of a diffuser according to an embodiment of the present disclosure.
Figure 15:
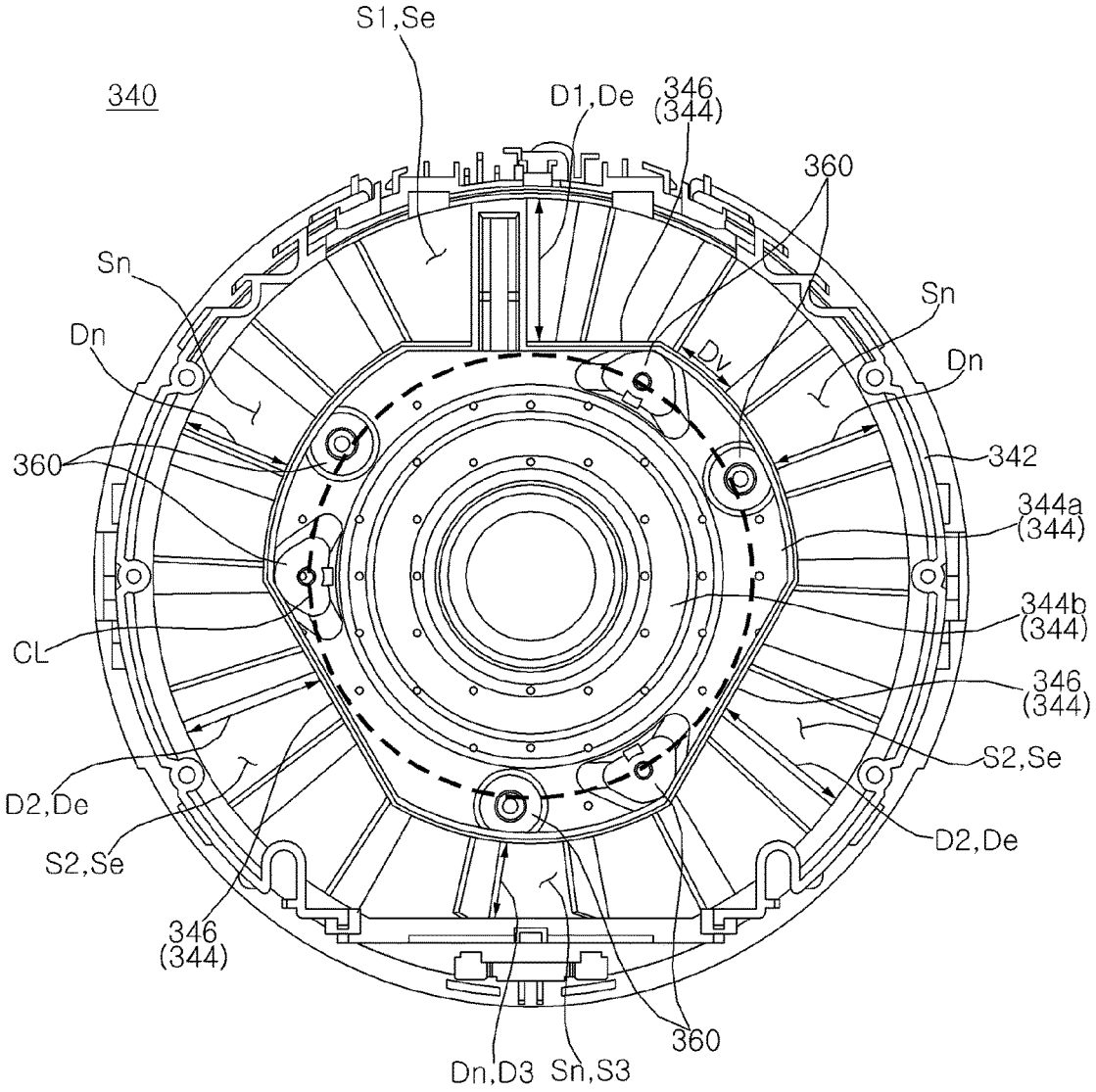
FIG. 15 is a plan view of FIG. 15
Figure 16:
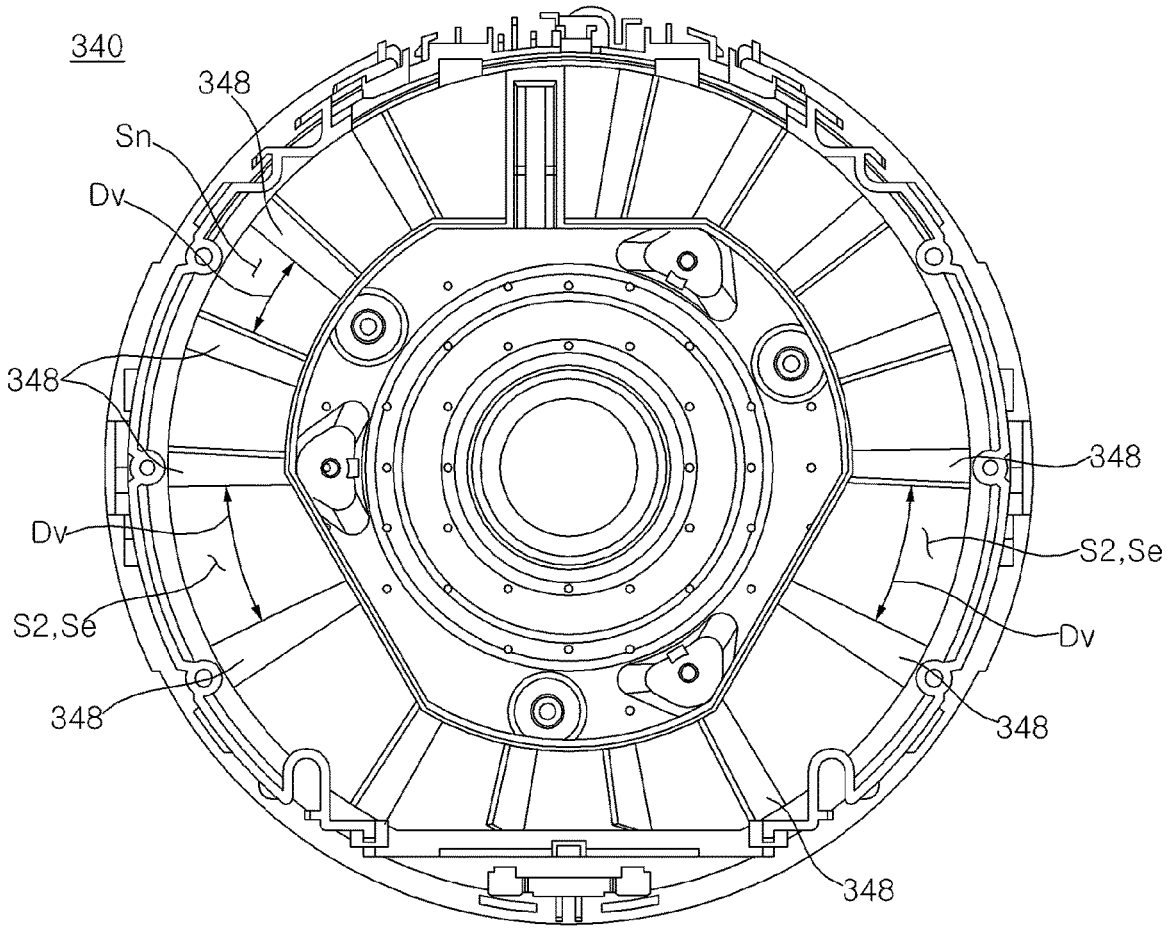
FIG. 16 is a plan view of a diffuser according to another embodiment of the present disclosure.

The first area S1 in the air passage S of the diffuser 340 is defined as a projected area in which the penetrating member 362 is projected to the air passage S of the diffuser 340, and the separation distance D may be formed to be larger in the first area S1 than in an area adjacent to the first area S1 (see FIGS. 13 to 15).

In this case, based on the premise of straightness of air flow indicating that air discharged from the blower fan 320 flows straight, the projected area in which a specific component is projected to the air passage S of the diffuser 340 may refer to a specific area, from which air to flow toward a specific component is discharged, in the air passage S of the diffuser 340. Hereinafter, the "area in which a specific component is projected to the air passage S" may be simply referred to as a "projected surface" or a "projected area."

The first area S1 may refer to a specific area, from which air to flow toward the penetrating member 362 is discharged, in the air passage S of the diffuser 340. The first area S1 may be understood as a virtual area in which the penetrating member 362 is vertically projected to the air passage S of the diffuser 340. The air discharged from the projected area in the air passage of the diffuser 340 may flow toward the penetrating member 362. The separation distance D in the first area S1 may be referred to as the first separation distance D1.

As the separation distance D in the first area S1 is larger than that in an adjacent area, a volume of air passing through the first area S1 and discharged from the diffuser 340 may be greater than a volume of air passing through the adjacent area and discharged from the diffuser 340. Accordingly, even with a local flow resistance caused by the penetrating member 362, a volume of air per unit time that reaches the discharge ports 117 and 127 after passing through the first area S1 may be similar to a volume of air that reaches the discharge ports 117 and 127 after passing through the adjacent area.

The upper case 140 may include a first discharge case 110 and a second discharge case 120 (see FIG. 1).

The first discharge case 110 may have the first discharge port 117. The first discharge case 110 may include a first discharge passage O1 formed therein, through which air flows toward the first discharge port 117. The first discharge port 117 may be formed as an opening in the first discharge case 110. The first discharge passage O1 may be understood as an inner space of the first discharge case 110. The air flowing through the first discharge passage O1 may be discharged through the first discharge port 117. The first discharge case 110 may have a cylindrical shape or a truncated cone shape.

The first discharge case 110 may be referred to as the first tower 110. The first tower 110 may have a tower shape that is elongated upward. The first discharge port 117 may also be elongated in a longitudinal direction of the first tower 110. However, the technical idea of the present disclosure is not limited by the shape of the first discharge case 110, and may be applied regardless of the shape of the first discharge case 110.

The second discharge case 120 may have the second discharge port 127. The second discharge case 120 may include a second discharge passage O2 formed therein, through which air flows toward the second discharge port 127. The second discharge port 127 may be formed as an opening in the second discharge case 120. The second discharge passage O2 may be understood as an inner space of the second discharge case 120. The air flowing through the second discharge passage O2 may be discharged through the second discharge port 127. The second discharge case 120 may have a cylindrical shape or a truncated cone shape.

The second discharge case 120 may be referred to as the second tower 120. The second tower 120 may have a tower shape that is elongated upward. The second tower 120 is spaced apart laterally from the first tower 110 such that a space BS may be formed therebetween. However, the technical idea of the present disclosure is not limited by the shape of the second discharge case 120, and may be applied regardless of the shape of the second discharge case 120.

The second discharge case 120 is spaced apart from the first discharge case 110, such that the space BS may be formed therebetween. The space BS may be a space in which the air discharged from the first discharge port 117 and the second discharge port 127 flows, and may be referred to as a "blowing space 105." The first discharge case 110 and the second discharge case 120 may be symmetrical to each other with respect to the space BS formed therebetween.

Each of the first discharge passage O1 and the second discharge passage O2 may communicate with the intermediate passage M of the middle case 130. Specifically, the first discharge passage and the second discharge passage may be connected in series to the intermediate passage 130 and may be parallel to each other. The air discharged from the diffuser 340 may pass through the intermediate passage M to be distributed to each of the first discharge passage O1 and the second discharge passage O2 (see FIG. 6).

A second area S2 in the air passage S of the diffuser 340 is defined as an area in which the first discharge passage O1 and the second discharge passage O2 are projected to the air passage S, and the separation distance D in at least a portion of the second area S2 may be formed to be larger than in an area adjacent to the second area S2. The distribution of the separation distance D may be symmetrical with respect to a third area S3 in which the space BS is projected to the air passage S (see FIGS. 14 and 15).

In the air passage S of the diffuser 340, the second area S2 may refer to a specific area, from which some of the air, discharged from the diffuser 340, is discharged to flow straight (or almost straight) to the first discharge passage or the second discharge passage. The second area S2 may be understood as a virtual area in which the first discharge passage and the second discharge passage are vertically projected to the air passage S of the diffuser 340. The air discharged from the second area S2 may pass through the intermediate passage M without any resistance because of straightness, to flow directly to the first discharge passage or the second discharge passage. The separation distance D in the second area S2 may be referred to as a second separation distance D2. The separation distance D in the third area S3 may be referred to as a third separation distance D3. The third separation distance D3 may be smaller than the second separation distance D2.

The air discharged from an area adjacent to the second area S2 may be subjected to the flow resistance until the air reaches the discharge passage. Particularly, after air is discharged from the third area S3, which is one of areas adjacent to the second area S2, and flows almost straight through the intermediate passage M, the air first collides with a bridge surface 131 which will be described later, and then is changed in flow direction to be distributed to the first discharge passage O1 and the second discharge passage O2.

Accordingly, a passage width of the second area S2 is larger than that of the adjacent area, such that the volume of air, discharged from the second area S2, has a larger proportion of the total volume of air per unit time discharged from the diffuser 340, thereby minimizing internal resistance on a path of the air flow to reach the discharge ports 117 and 127.

As described above, by adjusting the discharge passages, connected to each of the plurality of discharge ports 117 and 127, according to a passage width of the diffuser 340, the air may flow directly and straight toward the discharge ports 117 and 127, thereby increasing the proportion of air reaching the discharge ports 117 and 127 and reducing the flow resistance in the blower 1. Further, the volume of air may be distributed uniformly to each of the plurality of discharge ports 117 and 127, such that the performance of the blower 1 may be improved.

In a structure of the blower 1 in which the lower case, the middle case 130, and the upper case 140 are stacked from bottom to top, it is required to provide a structure for supporting the load at the top of the blower 1. Particularly, as the first tower 110 and the second tower 120 are laterally spaced apart from each other, resistance of the blower 1 to external force to widen or narrow the two towers may be weak.

Accordingly, the bridge surface 131 may connect lower ends of side walls 115 and 125 of the first tower 110 and the second tower 120 that face each other with respect to the space BS (see FIGS. 1 and 5 to 7). The bridge surface 131 may be an upper surface of the tower base 130. The bridge surface 131 may form a continuous surface with an inner wall (first inner wall) 115 of the first tower 110. The bridge surface 131 may form a continuous surface with an inner wall (second inner wall) 125 of the second tower. The bridge surface 131 may fix the first tower 110 and the second tower 120 and may receive load from the first tower 110 and the second tower 120.

Some of the air, discharged from the diffuser 340 and flowing through the intermediate passage M, may reach the bridge surface 131 to be distributed to the first tower 110 and the second tower 120 by flowing along the bridge surface 131. The bridge surface 131 may be formed as a curved surface that is convex downward, thereby facilitating distribution of the flow.

A supporter may have a lower portion connected to an upper end of the inner wall 344 and an upper portion connected to the lower part of the bridge surface 131, such that a load may be transferred from the bridge surface 131 to the inner wall 344. The supporter, disposed between the diffuser 340 and the bridge surface 131, may connect the diffuser 340 and the bridge surface 131 (see FIGS. 5 to 7 and 13).

Connection of the lower portion of the supporter to the upper end of the inner wall 344 may include not only a direct connection thereof, but also an indirect connection thereof by providing another structure therebetween.

The supporter may have a predetermined pillar shape in order not to interrupt the flow in the blower 1 while transferring the load. For example, in order to uniformly transfer the load to the inner wall 344, a planar cross-section of a lower end of the supporter may correspond to a planar cross-section of the upper end of the inner wall 344. In addition, the supporter may have a cone shape or a truncated cone shape in which the planar cross-section decreases upwardly, so as to reduce the flow resistance in the blower 1.

As the entire load of the inner wall of the first tower 110 and the second tower 120 is transferred to the inner wall 344 via the supporter, there may be a problem with durability of the inner wall 344. Accordingly, the plurality of vanes 348 may have radial inner ends which are connected to the inner wall 344, and radial outer ends connected to the outer wall 342. That is, the plurality of vanes 348 not only divide the air passage S but also serve to connect the inner wall 344 and the outer wall 342, thereby distributing the load, applied to the inner wall 344, to the outer wall 342.

Accordingly, in a structure in which it is required to stably transfer the load from the top of the blower 1 to the bottom of the blower 1, particularly in the blower 1 having the shape of twin towers which are spaced apart from each other, the inner wall 344 and the outer wall 342 are connected by the vanes 348 of the diffuser 340 for guiding an air flow while transferring the load from the top of the blower 1 to the inner wall 344 of the diffuser 340, thereby distributing the burden of load of the inner wall 344 to the outer wall 342, and improving structural rigidity of the diffuser 340.

The air passage S of the diffuser 340 may include a normal area Sn, in which the separation distance D is a predetermined value (or a normal separation distance Dn), and an extended area Se in which the separation distance D is greater than the predetermined value Dn (see FIGS. 14 and 15).

The normal area Sn may refer to an area in which the separation distance D is not extended compared to other areas in the air passage S. The normal area Sn may be a relative concept that is determined in comparison to other areas. A normal separation distance Dn may refer to the separation distance D of the normal area Sn. The normal area Sn may be a concept including the aforementioned third area S3. The normal separation distance Dn may be a concept including the aforementioned third separation distance D3.

The separation distance D between the inner wall 344 and the outer wall 342 of an existing diffuser 340, in which the separation distance D is not separately extended or reduced, is generally adjusted according to a width of a discharge portion of the fan 320. This is for allowing air discharged from the fan 320 to completely pass through the diffuser 340. Accordingly, the normal separation distance Dn may be the same as or similar to the width of the discharge portion of the fan 320. However, if necessary, the normal separation distance Dn may be smaller than the width of the discharge portion of the fan 320, thereby increasing velocity or pressure of the air discharged from the blower 1.

The extended area Se may refer to an area in which the separation distance D is extended compared to other areas in the air passage S. The extended area Se may be a relative concept that is determined in comparison to other areas. An extended separation distance Dn may refer to the separation distance D of the extended area Se. The extended area Se may be a concept including the aforementioned first area S1 and second area S2. The extended separation distance De may be a concept including the aforementioned first separation distance D1 and the second separation distance D2.

A recessed portion 346, which is recessed radially inward, may be formed in the inner wall 344. The recessed portion 346 may be referred to as a bent portion 346. The bent portion 346 may be formed in a shape in which the inner wall 344 is pressed radially inward in the extended area Se. As the inner wall 344 is recessed radially inward, the separation distance D between the outer wall 342 and the inner wall 344 may increase.

Compared to the case where the outer wall 342 is bent outward to widen the passage of the diffuser 340, the inner wall 344 is bent inward, thereby simply widening the passage of the diffuser 340 while maintaining a total volume of the diffuser 340, such that an air volume of the blower 1 may increase.

The recessed portion 346 or the bent portion 345 may be formed by pressing the inner wall 344 in a radially inward direction. However, the technical idea of the present disclosure is not limited to the process of forming the recessed portion 346 or the bent portion 346. For example, the recessed portion 346 or the bent portion 346 may also be formed by methods, such as thermal deformation, injection molding, and the like.

The recessed portion 346 may have a planar shape. In this case, the outer wall 342 may have a planar cross-section in a circular shape, and the inner wall 344 may be formed as a chord connecting a plurality of arcs to adjacent arcs.

Figure 17:
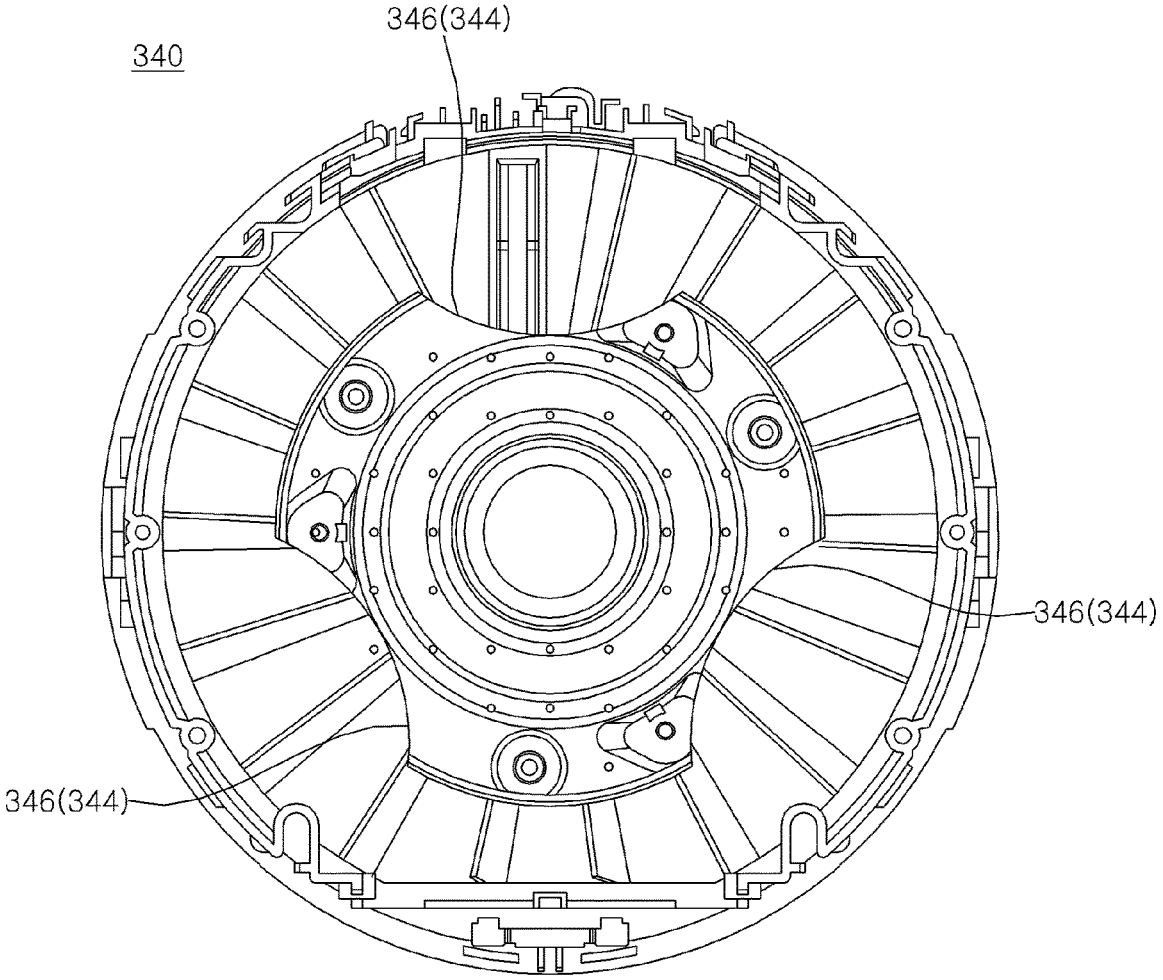
FIG. 17 is a plan view of a diffuser according to yet another embodiment of the present disclosure.

Alternatively, the recessed portion 346 may be a curved surface which is convex inward (see FIG. 17). As the bent portion 346 is formed as a curved surface that is convex inward, the width of the air passage S may further increase compared to the case where the bent portion 346 is simply formed as a planar surface.

As described above, the inner wall 344 of the diffuser 340 may share the load at the top of the blower 1. In this case, the bent portion 346 (recessed portion 346) which is bent inward is formed in the inner wall 344, the load at the top of the blower 1 may be concentrated on the bent portion 346. This is because, as a center of gravity of the blower 1 is positioned on the planar cross-section, a greater load is applied to a center portion, and thus the load is concentrated on the bent portion 345 of the inner wall 344, which is bent inward and located in proximity to the center of gravity of the blower 1 compared to other portions.

Generally, the blower 1 may have an interior shape that is symmetrical with respect to the rotating shaft of the fan 320 or the motor shaft 312 of the fan motor 310. Accordingly, the load applied to the inner wall 344 from the top of the blower 1 may be applied in a uniformly distributed manner on a virtual circumference around a central axis. Thus, when the inner wall 344 is recessed inward to secure a passage width of the diffuser 340, there may be a problem in that the load is concentrated on the recessed portion 346 on the circumference CL.

The blower 1 may further include a sub-column 360 disposed within the inner wall 344. The sub-column 360 may be disposed on the same circumference CL as the recessed portion 346 with respect to the center of the inner wall 344 (see FIG. 15).

As the sub-column 360 is disposed on the same circumference CL as the recessed portion 346, the sub-column 360 and the recessed portion 346 may be spaced apart by the same radius from the center of the inner wall 344 (or the center of gravity of the blower 1 on the planar cross-section). Accordingly, the sub-column 360 and the recessed portion 346 may share the load applied from the top of the blower 1.

Accordingly, the sub-column 360 disposed within the inner wall 344 and the recessed portion 346 of the inner wall 344 support the load at the top of the blower 1 on the same circumference CL, thereby preventing damage to the inner wall 344 when the load is concentrated on the recessed portion 346 of the inner wall 344, and improving structural stability of the blower 1.

A lower end of the sub-column 360 may be connected to the sub-part 344*b* of the inner wall 344. The sub-part 344*b* of the inner wall 344 may support the lower end of the sub-column 360. The sub-column 360 may have a pillar shape with a length which is the same as or similar to the main part 344*a* of the inner wall 344. An upper end of the sub-column 360 may be coupled to the lower portion of the supporter.

While the sub-column 360 is disposed to share the load as described above, the sub-column 360 may also be disposed in a shape that surrounds an outer circumference of the fan motor 310 to tightly secure the outer circumference of the fan motor 310. It is obvious that by securing the fan motor 310, vibrations and noise of the blower 1 may be reduced.

The plurality of vanes 348 may be spaced apart from each other around an outer circumference of the inner wall 344. The plurality of vanes 348 may be spaced apart from each other around an inner circumference of the outer wall 342.

The plurality of vanes 348 may be equally spaced apart around the circumference of the inner wall 344 or the outer wall 342 (see FIGS. 14 and 15). That is, unit passages ss divided by the vanes 348 may be spaced apart by equal separation distance Dv around the circumference. As the vanes 348 are spaced apart by equal separation distance Dv around the circumference, the vanes 348 may uniformly guide a flow direction regardless of an area of the unit passages ss.

By contrast, the plurality of vanes 348 may not be equally spaced apart. The separation distance Dv between adjacent vanes 348 of the plurality of vanes 348 in the extended area Se may be greater than a normal area Sn (see FIG. 16). The separation distance Dv between the vanes 348 may be understood as a separation distance between the vanes 348 on the circumference. That is, the number of vanes 348 disposed in the normal area Sn may be greater than the number of vanes 348 disposed in the extended region Se.

Accordingly, while the vanes 348 may serve to guide a flow in an upward direction, the vanes 348 may also locally increase flow resistance. Thus, an air volume in a specific area may be improved by reducing the number of vanes 348 in an area in which it is required to secure the air volume.

A plurality of grooves (not shown) may be formed circumferentially in an inner surface of the outer wall 342 and an outer surface of the inner wall 344. Separation distances between adjacent grooves of the plurality of grooves may be equally spaced apart. The plurality of vanes 348 may be press-fitted into predetermined grooves of the plurality of grooves, to be fastened thereto.

A separation distance between the vanes 348 in the extended region Se may be adjusted simply by allowing the vanes 348 to be selectively fastened to the grooves formed at equal intervals. In addition, when an internal structure of the blower 1 is changed by adding an option and the like during use of the blower 1, it is possible to simply adjust the blower according to the changed structure.

Hereinafter, the upper case 140, the blowing space 105, and a flow of discharged air will be described with reference to FIGS. 1 to 4.

As described above, the upper case 140 may include the first tower 110 and the second tower 120 which are separately disposed and are in the shape of two pillars. In this embodiment, the first tower 110 may be disposed on the left side, and the second tower 120 may be disposed on the right side. The first tower 110 and the second tower 120 may be separated from each other, and the blowing space 105 may be formed between the first tower 110 and the second tower 120.

In this embodiment, the blower space 105 may be open at the front, rear, and/or the top.

The upper case 140 including the first tower 110, the second tower 120, and the blowing space 105 may be formed in a truncated cone shape.

The discharge ports 117 and 127 formed in the first tower 110 and the second tower 120, respectively, may discharge air into the blowing space 105. If it is required to distinguish the discharge ports 117 and 127, one of the discharge ports 117 and 127, which is formed in the first tower 110, may be referred to as the first discharge port 117, and the other one of the discharge ports 117 and 127, which is formed in the second tower 120, may be referred to as the second discharge port 127.

The first and second discharge ports 117 and 127 may be disposed within the height of the blowing space 105, and a transverse direction across the blowing space 105 is defined as an air discharge direction.

As the first tower 110 and the second tower 120 are disposed on the left and right sides, the air discharge direction may be formed in a front-rear direction and an up-down direction in this embodiment.

That is, the air discharge direction across the blowing space 105 may include a first air discharge direction F1 that is horizontally oriented and a second air discharge direction F2 that is vertically oriented.

Air flowing in the first air discharge direction F1 is referred to as a horizontal airflow, and air flowing in the second air discharge direction F2 is referred to as an ascending airflow.

It should be understood that the horizontal airflow does not mean that the air flows only in the horizontal direction, but that a flow rate of air flowing in the horizontal direction is larger. Likewise, it should be understood that the ascending airflow does not mean that the air flows only upward, but that a flow rate of air flowing upward is larger.

In this embodiment, a gap between upper ends of the blowing space 105 may be equal to a gap between lower ends thereof. Unlike this embodiment, the gap between the upper ends of the blowing space 105 may also be narrower or wider than the gap between the lower ends thereof.

As the blowing space 105 has a uniform horizontal width, a flow of air flowing in front of the blowing space 105 may be formed more uniformly.

For example, when a width of the upper side and a width of the lower side are different, a flow velocity of the wider side may be formed low, and a deviation of the velocities may occur based on the up-down direction. When the velocity deviation of the air occurs in the up-down direction, an air reaching length may vary.

The air discharged from the first discharge port 117 and the air discharged from the second discharge port 127 may join each other in the blowing space 105 to flow to a user.

That is, in this embodiment, without individually flowing to the user, the air discharged from the first discharge port 117 and the air discharged from the second discharge port 127 may join in the blowing space 105, and then is provided to the user.

The blowing space 105 may be used as a space in which the discharged air flows join each other and are mixed. In addition, air behind the blowing space 105 may also flow into the blowing space 105 by the air discharged into the blowing space 105.

As the air discharged from the first discharge port 117 and the air discharged from the second discharge port 127 join in the blowing space 105, straightness of the discharged air may be improved. In addition, by joining the air discharged from the first discharge port 117 and the air discharged from the second discharge port 127 in the blowing space 105, air around the first tower and second tower can also indirectly flow in the air discharge direction.

In this embodiment, the first air discharge direction F1 may be oriented from rear to front, and the second air discharge direction F2 may be oriented from bottom to top.

An upper end 111 of the first tower 110 and an upper end 121 of the second tower 120 may be spaced apart from each other for the second air discharge direction F2. That is, the air discharged in the second air discharge direction F2 causes no interference with the case 100 of the blower 1.

Further, for the first air discharge direction F1, a front end 112 of the first tower 110 and a front end 122 of the second tower 120 may be spaced apart from each other, and a rear end 113 of the first tower 110 and a rear end 123 of the second tower 120 may also be spaced apart from each other.

In each of the first tower 110 and the second tower 120, a surface facing the blowing space 105 is referred to as an inner wall, and a surface not facing the blowing space 105 is referred to as an outer wall.

An outer wall 114 of the first tower 110 and an outer wall 124 of the second tower 120 may be disposed in opposite directions, and an inner wall 115 of the first tower 110 and an inner wall 125 of the second tower 120 may face each other.

If it is necessary to distinguish the inner walls 115 and 125, the inner wall of the first tower 110 is referred to as the first inner wall 115, and the inner wall of the second tower 120 is referred to as the second inner wall 125.

Likewise, if it is necessary to distinguish the outer walls 114 and 124, the outer wall of the first tower 110 is referred to as the first outer wall 114, and the outer wall of the second tower 120 is referred to as the second outer wall 124.

The first tower 110 and the second tower 120 may be formed in a streamlined shape with respect to the flow direction of air.

Specifically, each of the first inner wall 115 and the first outer wall 114 is formed in a in a streamlined shape in the front-rear direction, and each of the second inner wall 125 and the second outer wall 124 is formed in a streamlined shape in the front-rear direction.

The first discharge port 117 is formed in the first inner wall 115, and the second discharge port 127 is formed in the second inner wall 125.

A shortest distance between the first inner wall 115 and the second inner 125 is referred to as B0. The discharge ports 117 and 127 may be disposed behind the shortest distance B0.

A separation distance between the front end 112 of the first tower 110 and the front end 122 of the second tower 120 is referred to as a first separation distance B1, and a separation distance between the rear end 113 of the first tower 110 and the rear end 123 of the second tower 120 is referred to as a second separation distance B2.

In this embodiment, B1 and B2 may be equal to each other. Unlike this embodiment, any one of B1 or B2 may be longer than the other.

The first discharge port 117 and the second discharge port 127 may be formed between B0 and B2.

Preferably, the first discharge port 117 and the second discharge port 127 are disposed closer to the rear end 113 of the first tower 110 and the rear end 123 of the second tower 120 than B0. As the discharge ports 117 and 127 are disposed closer to the rear ends 113 and 123, air flow may be easily controlled by the Coanda effect.

The inner wall 115 of the first tower 110 and the inner wall 125 of the second tower 120 may directly provide the Coanda effect, and the outer wall 114 of the first tower 110 and the outer wall 124 of the second tower 120 may indirectly provide the Coanda effect.

The inner walls 115 and 125 may directly guide the air discharged from the discharge ports 117 and 127 to the front ends 112 and 112.

That is, the horizontal airflow of the air discharged from the discharge ports 117 and 127 may be directly provided.

Due to an air flow in the blowing space 105, an indirect air flow occurs in the outer walls 114 and 124.

The outer walls 114 and 124 may induce a Coanda effect with respect to the indirect air flow, and may guide the indirect air flow to the front ends 112 and 122.

A left side of the blowing space 105 is blocked by the first inner wall 115, and a right side of the blowing space 105 is blocked by the second inner wall 125, but an upper side of the blowing space 105 may be opened.

An airflow converter to be described later may convert the horizontal airflow passing through the blowing space 105 into the ascending airflow, and the ascending airflow may flow to the open upper side of the blowing space 105. The ascending airflow suppresses the direct flow of discharged air to the user and may allow for active convection of indoor air.

In addition, a width of discharged air may be adjusted using the flow rate of air that joins in the blowing space 105.

By having a vertical length of the first discharge port 117 and the second discharge port 127 which are much longer than the horizontal widths B0, B1, and B2 of the blowing space 105, the discharged air of the first discharge port 117 and the discharged air of the second discharge port 127 may be caused to join each other in the blowing space 105.

Hereinafter, the overall shape of the blower 1 will be described with reference to FIGS. 1 to 4.

The blower 1 may have a pillar shape having a diameter that decrease upward. The blower 1 may have a substantially cone shape or a truncated cone shape. In this embodiment, the lower case 150 may have a diameter that gradually decreases toward the upper end. The middle case 130 may have a diameter that gradually decreases toward the upper end. The upper case 140 may also have a diameter that gradually decreases toward the upper end.

Unlike this embodiment, the blower 1 may include a form in which two towers are disposed. In addition, unlike this embodiment, it is not necessary to have a shape with a cross-section that becomes narrower toward the top.

However, as shown in this embodiment, if the cross-section becomes narrower toward the top, the center of gravity is lowered and a risk of inversion due to an external force is reduced.

Unlike this embodiment, the lower case 150, the middle case 130, and the upper case 140 may be integrally formed with each other. For example, the lower case 150, the middle case 130, and the upper case 140 may be manufactured in the form of a front case and a rear case which are integrally formed, and then assembled with each other.

The outer surfaces of the lower case 150, the middle case 130, and the upper case 140 may be formed continuously. Particularly, a lower end of the tower base 130 and an upper end of the lower case 150 may be in close contact with each other, and the outer surface of the tower base 130 and the outer surface of the lower case 150 may form a continuous surface. To this end, a diameter of the lower end of the tower base 130 may be slightly smaller than a diameter of the upper end of the lower case 150.

The lower case 150 may have an inner space and the suction port 155 formed in a circumference thereof. The lower case 150 may further include a base 151 which is seated on the ground. The lower case 150 may be separated laterally to provide a path for removing or installing a filter. In this embodiment, the suction port 155 may be formed along the circumference of the lower case 150, thereby suctioning air in all directions 360 degrees. In this embodiment, the suction port 155 may be formed in the shape of a hole, and may have various shapes.

The tower base 130 may distribute air supplied from the lower case 150, and may provide the distributed air to the first tower 110 and the second tower 120. The tower base 130 may connect the first tower 110 and the second tower 120. The blowing space 105 may be disposed at an upper side of the tower base 130. In addition, the discharge ports 117 and 127 may be formed at the upper side of the tower base 130, and the ascending airflow and the horizontal airflow may be formed at the upper side of the tower base 130.

In order to minimize a friction with air, an upper surface 131 of the tower base 130 may be formed as a curved surface. Particularly, the upper surface 131 may be formed as a curved surface which is concave downward, and may extend in the front-rear direction. A first side 131*a* of the upper surface 131 may be connected to the first inner wall 115, and a second side 131*b* of the upper surface 131 may be connected to the second inner wall 125. The upper surface 131, the first inner wall 115, and the second inner wall 125 may form a continuous surface. The upper surface 131 of the tower base 130 may be referred to as a bridge surface 131.

Figure 4:
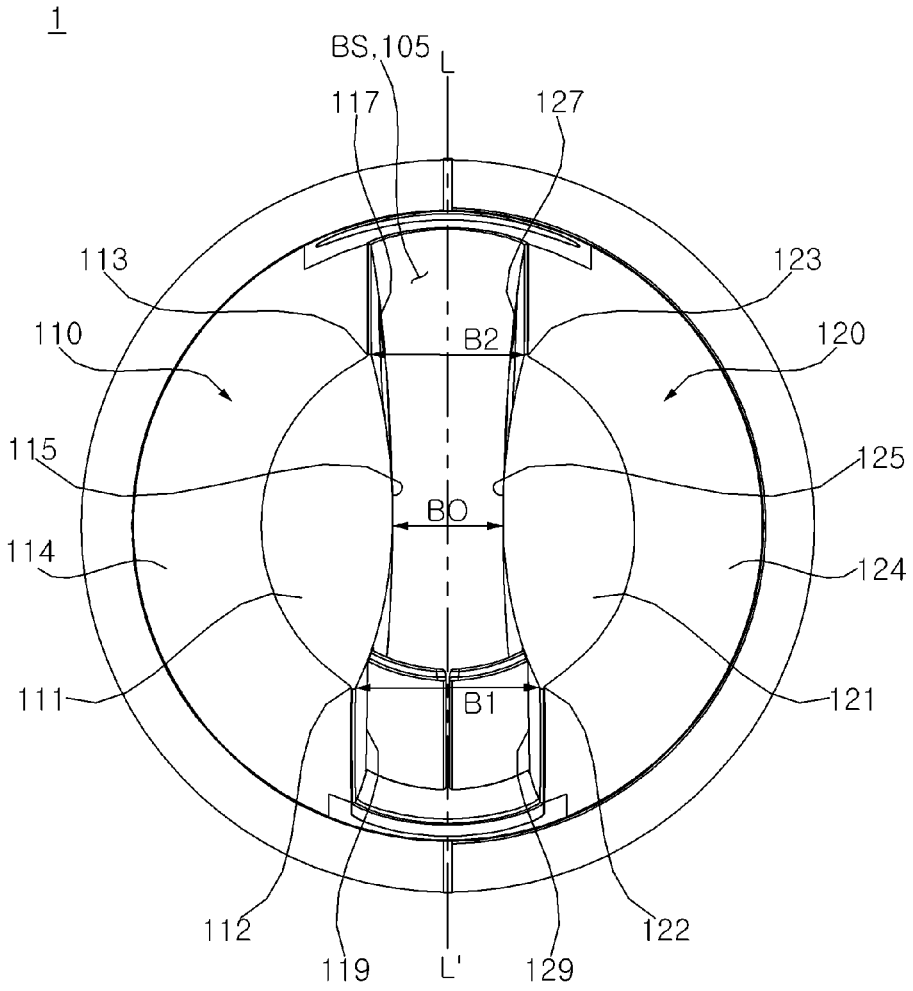
FIG. 4 is a plan view of FIG. 3.

Referring to FIG. 4, when viewed from the top, the first tower 110 and the second tower 120 may be symmetrical to each other with respect to a center line L-L'. Particularly, the first discharge port 117 and the second discharge port 127 may be symmetrical to each other with respect to the center line L-L'.

The center line L-L' is an imaginary line between the first tower 110 and the second tower 120 and is disposed in a front-rear direction in this embodiment, and is disposed to pass through the upper surface 131.

Unlike this embodiment, it is also possible that the first tower 110 and the second tower 120 may be formed in an asymmetric shape. However, when the first tower 110 and the second tower 120 are disposed symmetrical with respect to the center line L-L', it is more advantageous to control horizontal airflow and ascending airflow.

Figure 5:
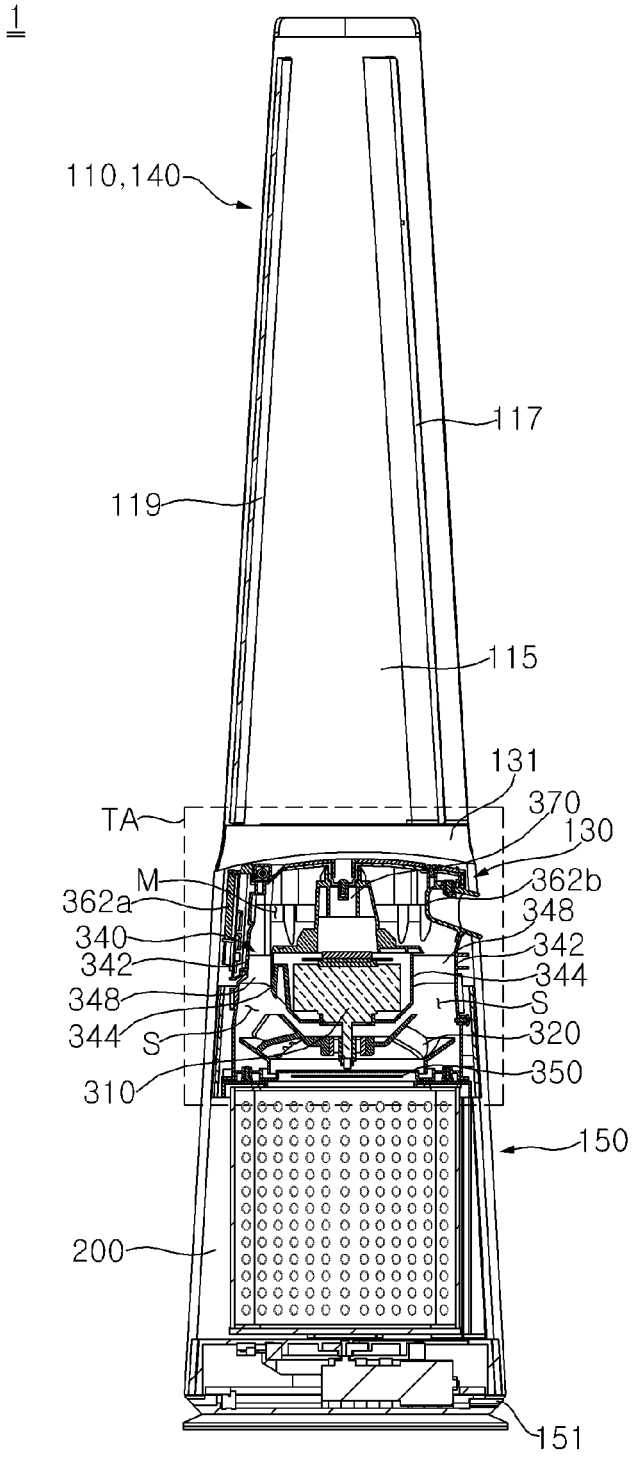
FIG. 5 is a right cross-sectional view of FIG. 2.
Figure 6:
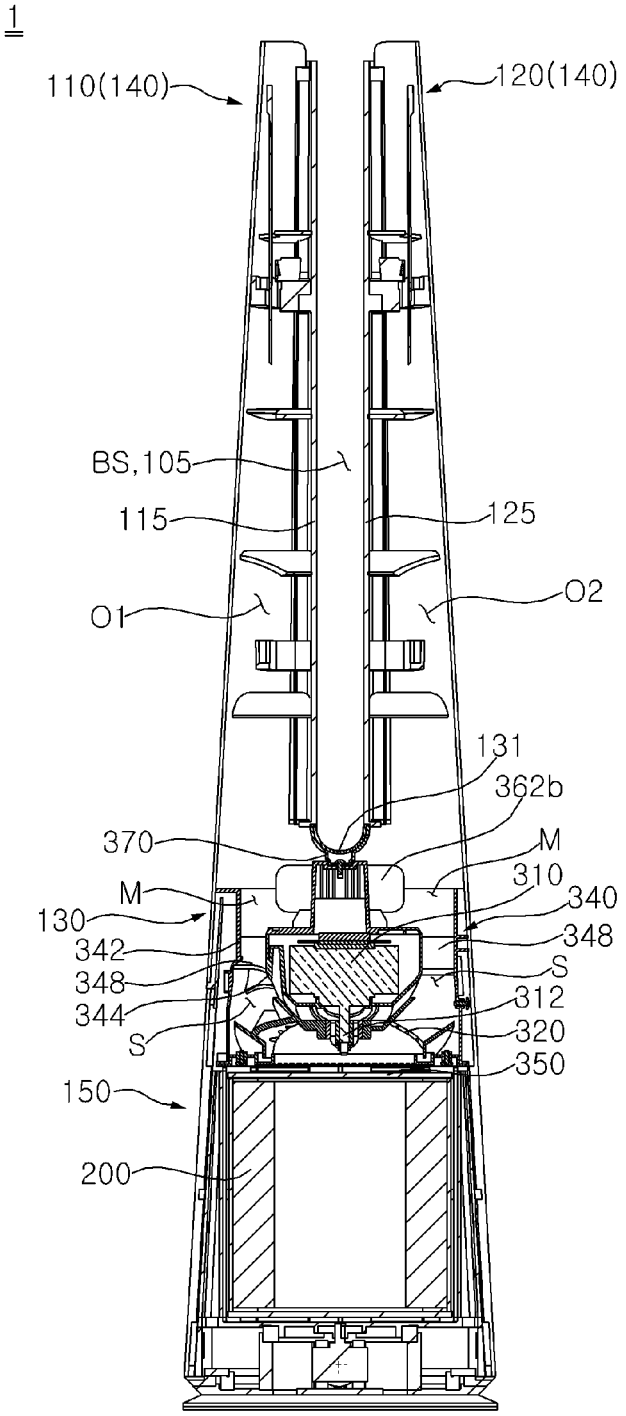
FIG. 6 is a front cross-sectional view of FIG. 2.
Figure 7:
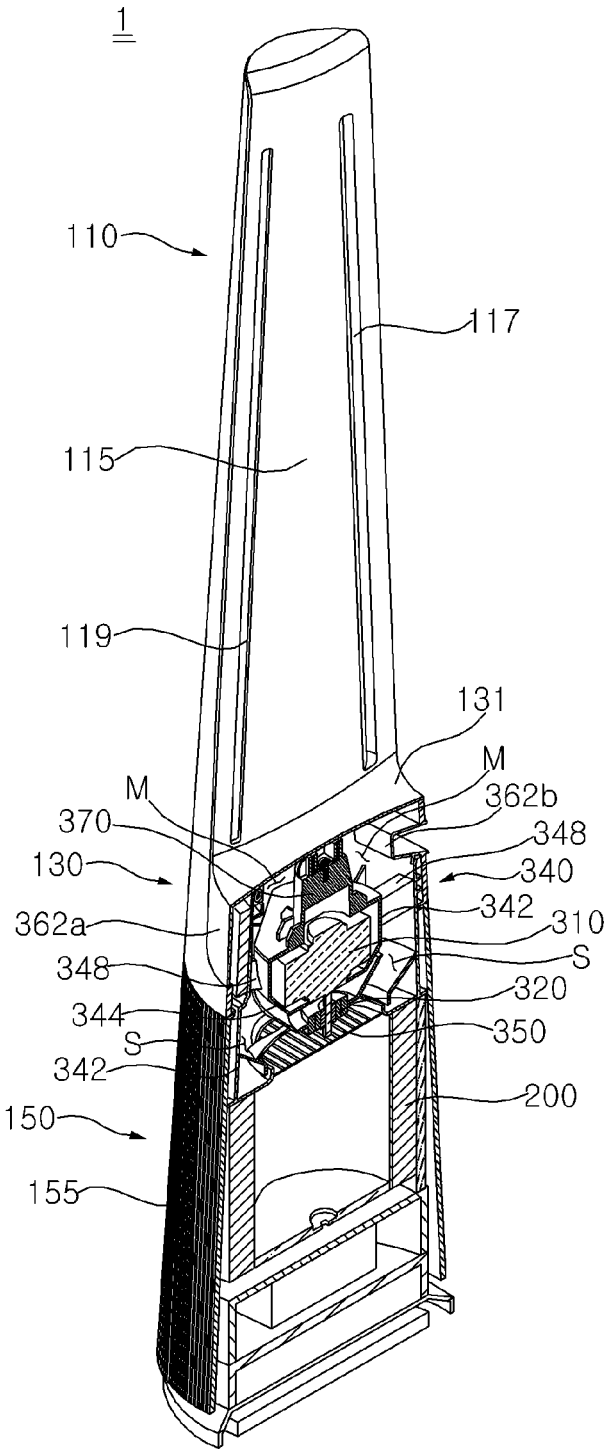
FIG. 7 is a cross-sectional perspective view of FIG. 1.

Referring to FIGS. 5 to 7, the blower 1 may include a filter 200 disposed in the case 100.

The filter 200 may be disposed in the lower case 150. The lower case 150 is removably disposed to provide a path for removing or installing the filter. A user may remove the lower case 150 to withdraw the filter 200 out of the case 100.

The filter 200 may be formed in a cylindrical shape which is hollow in the up-down direction therein. An outer surface of the filter 200 may be disposed opposite the suction port 155. Indoor air may pass through the filter from the outside toward the inside, and foreign substances or harmful gases may be removed from the air.

The fan will be described below with reference to FIGS. 5 to 7 and 13.

The fan 320 may be disposed in the lower case 150. The fan 320 may be disposed at an upper side of the filter 200. The fan 320 may cause the air, having passed through the filter 200, to flow to the first tower 110 and the second tower 120. The fan 320 may be rotated by the fan motor 310.

The fan motor 310 may be disposed above the fan 320, and the motor shaft 312 of the fan motor 310 may be coupled to the fan 320 disposed at a lower side thereof.

The fan motor 310 may be accommodated by the inner wall 344 of the diffuser. The inner wall 344 may have a shape that covers the entire fan motor 310. As the inner wall 344 covers the entire fan motor 310, flow resistance of air flowing from bottom to top may be reduced. In this case, in order to minimize volume in an up-down direction, a lower end of the inner wall 344 may be inserted into the fan 320 and may overlap with the fan 320.

However, as described above, the inner wall 344 of the diffuser accommodates the fan motor 310 merely for space efficiency, and it should not be construed as limiting the technical idea of the present disclosure.

The fan 320 may include a hub 322, to which the shaft of the fan motor 310 is coupled, a shroud 324 spaced apart from the hub, and a plurality of blades 326 connecting the hub and the shroud.

Air having passed through the filter 200 is drawn into the shroud, and then is pressurized by the rotating blade 326 to cause the air to flow. The hub 322 is disposed at the upper side of the blade 326, and the shroud 324 is disposed under the blade 326. The hub 322 may be formed in a bowl shape that is concave downward. A width of the discharge portion of the fan 320 may refer to a distance between the hub 322 and the shroud 324.

In this embodiment, a mixed flow fan may be used as the fan 320. The mixed flow fan has a characteristic of sucking air into an axial center, and radially discharging air, in which the discharged air is inclined with respect to the axial direction. The entire air flows from the lower side to the upper side, such that when air is discharged in the radial direction as in a general centrifugal fan, a large flow loss occurs due to the flow direction change. However, the technical idea of the present disclosure is not limited to the type of fan.

Meanwhile, a suction grill 350 may be disposed in the lower case 150. When the filter 200 is removed, the suction grill 350 prevents a finger of the user from entering the fan 320, thereby protecting the user and the fan 320.

The filter 200 may be disposed at a lower side of the suction grill 350, and the fan 320 may be disposed at an upper side thereof. The suction grill 350 has a plurality of through holes formed in the up-down direction so that air may flow.

Figure 8:
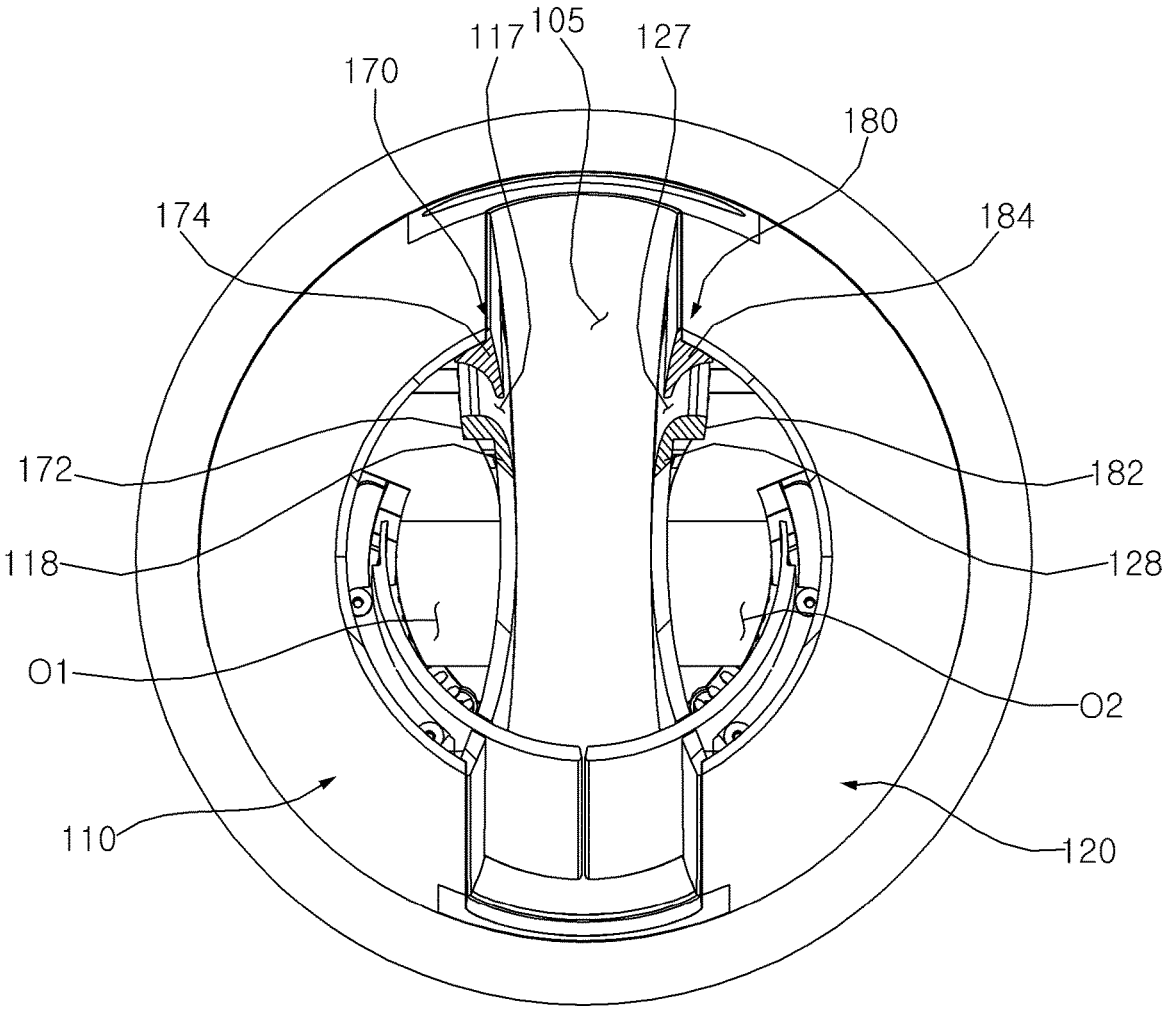
FIG. 8 is a plan view taken along line XI-XI of FIG. 3.
Figure 9:
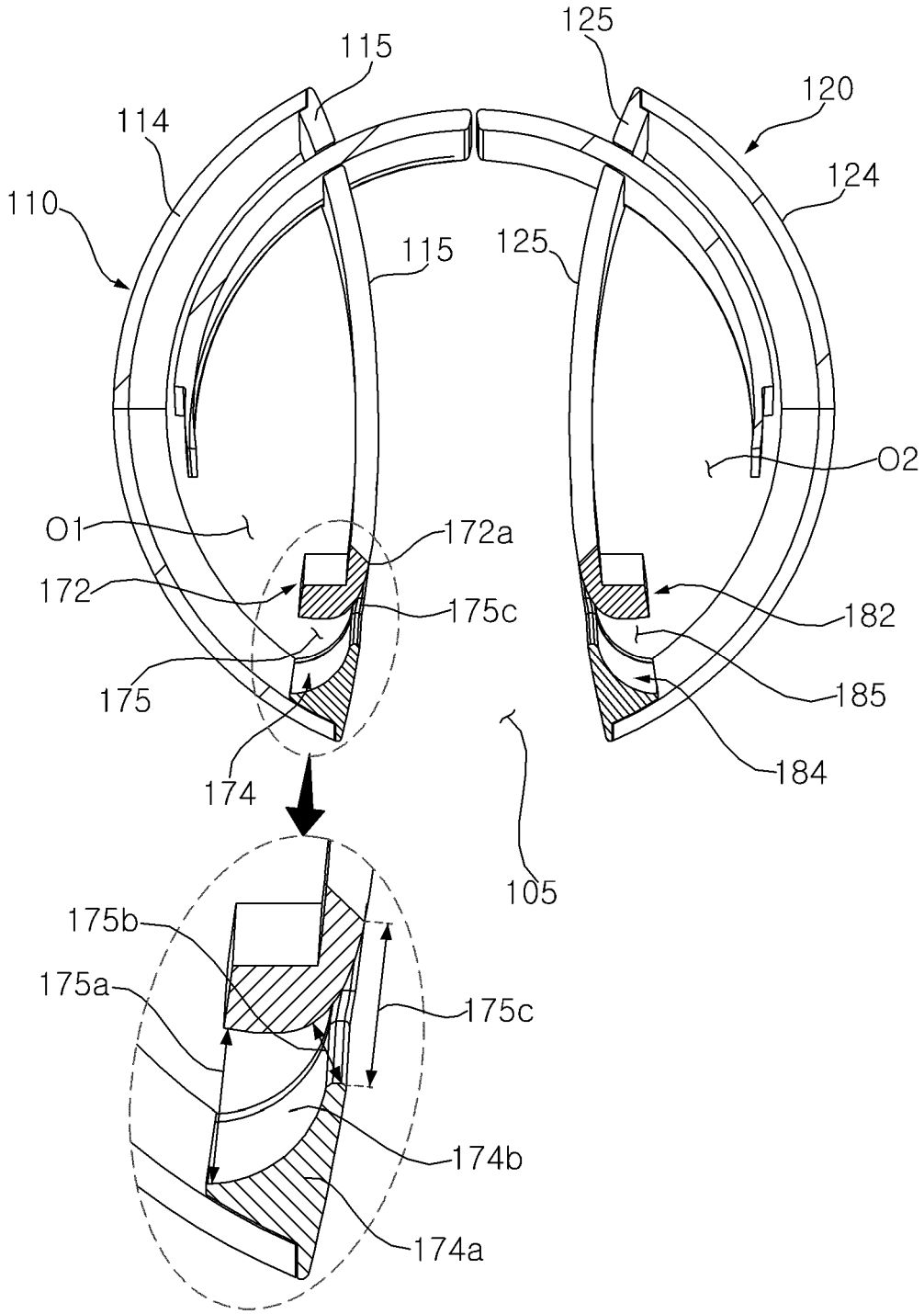
FIG. 9 is a bottom view taken along line IX-IX of FIG. 3.

Referring to FIGS. 8 and 9, the first discharge port 117 of the first tower 110 may be directed toward the second tower 120, and the second discharge port 127 of the second tower 120 may be directed toward the first tower 110.

The air discharged from the first discharge port 117 may flow along the inner wall 115 of the first tower 110 by the Coanda effect. The air discharged from the second discharge port 127 may flow along the inner wall 125 of the second tower 120 by the Coanda effect.

The first discharge part 170 forms the first discharge port 117, and includes a first discharge guide 172 which is disposed on an air discharge side of the first discharge port 117, and a second discharge guide 174 which forms the first discharge port 117 and is disposed on a side opposite the air discharge side of the first discharge port 117.

Outer surfaces 172*a* and 174*a* of the first discharge guide 172 and the second discharge guide 174 may provide a portion of the inner wall 115 of the first tower 110.

An inside of the first discharge guide 172 may be disposed to face the first discharge passage O1, and an outside thereof may be disposed to face the blowing space 105. An inside of the second discharge guide 174 may be disposed to face the first discharge passage O1, and an outside thereof may be disposed to face the blowing space 105.

An outer surface 172*a* of the first discharge guide 172 may be formed as a curved surface. The outer surface 172*a* may provide a continuous surface with the first inner wall 115. Particularly, the outer surface 172*a* may form a continuous curved surface with an outer surface of the first inner wall 115.

An outer surface 174*a* of the second discharge guide 174 may provide a continuous surface with the first inner wall 115. The inner surface 174*b* of the second discharge guide 174 may be formed as a curved surface. Particularly, the inner surface 174*b* may form a continuous curved surface with an inner surface of the first outer wall 114, thereby guiding air in the first discharge passage O1 toward the first discharge guide 172.

The first discharge port 117 may be formed between the first discharge guide 172 and the second discharge guide 174, and air in the first discharge passage O1 may be discharged into the blowing space 105 through the first discharge port 117.

Specifically, the air in the first discharge passage O1 may be discharged between the outer surface 172*a* of the first discharge guide 172 and the inner surface 174*b* of the second discharge guide 174, and a space between the outer surface 172*a* of the first discharge guide 172 and the inner surface 174*b* of the second discharge guide 174 is defined as a discharge gap 175. The discharge gap 175 forms a predetermined channel.

The discharge gap 175 is formed so that a width of the intermediate portion 175*b* is narrower than those of an inlet 175*a* and an outlet 175*c*. The intermediate portion 175*b* is defined as the shortest distance in the discharge gap 175.

A cross-sectional area of the discharge gap 175 gradually decreases from the inlet of the discharge gap 175 to the intermediate portion 175*b* thereof, and the cross-sectional area gradually increases again from the intermediate portion 175*b* to the outlet 175*c*. The intermediate portion 175*b* may be located inside the first tower 110. When viewed from the outside, the outlet 175*c* of the discharge gap 175 may be viewed as the discharge port 117.

In order to induce the Coanda effect, a radius of curvature of the inner surface 174*b* of the second discharge guide 174 may be greater than a radius of curvature of the outer surface 172*a* of the first discharge guide 172.

A center of curvature of the outer surface 172*a* of the first discharge guide 172 is located in front of the outer surface 172*a* and is formed inside the first discharge passage O1. A center of curvature of the inner surface 174*b* of the second discharge guide 174 is located on the side of the first discharge guide 172 and is formed inside the first discharge passage O1.

The second discharge part 180 forms the second discharge port 127, and includes a first discharge guide 182 which is disposed on an air discharge side of the second discharge port 127, and a second discharge guide 184 which forms the second discharge port 127 and is disposed on a side opposite the air discharge side of the second discharge port 127.

A discharge gap 185 may be formed between the first discharge guide 182 and the second discharge guide 184. The second discharge part 180 is symmetrical with the first discharge part 170, such that a detailed description thereof will be omitted.

The blower 1 may further include an airflow converter 400 for changing an air flow direction of the blowing space 105.

Figure 2:
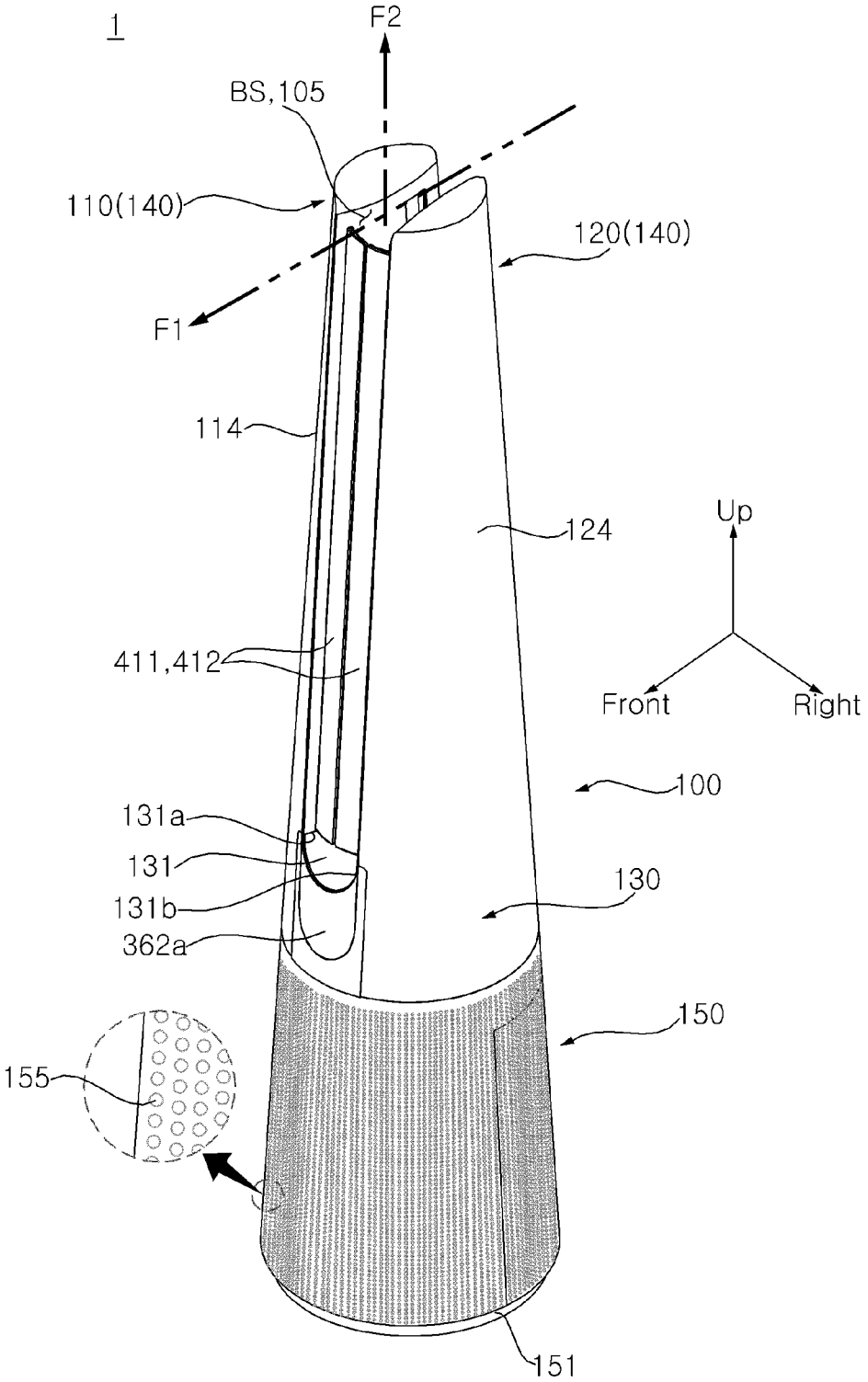
FIG. 2 is an exemplary view illustrating an example of an operation of FIG. 1.
Figure 3:
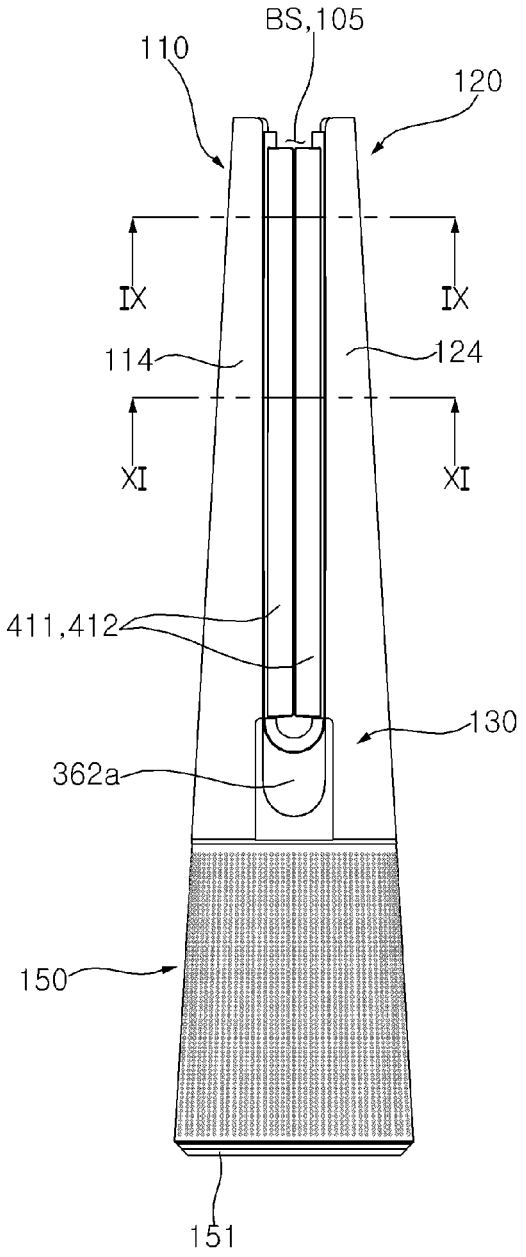
FIG. 3 is a front view of FIG. 2.
Figure 10:
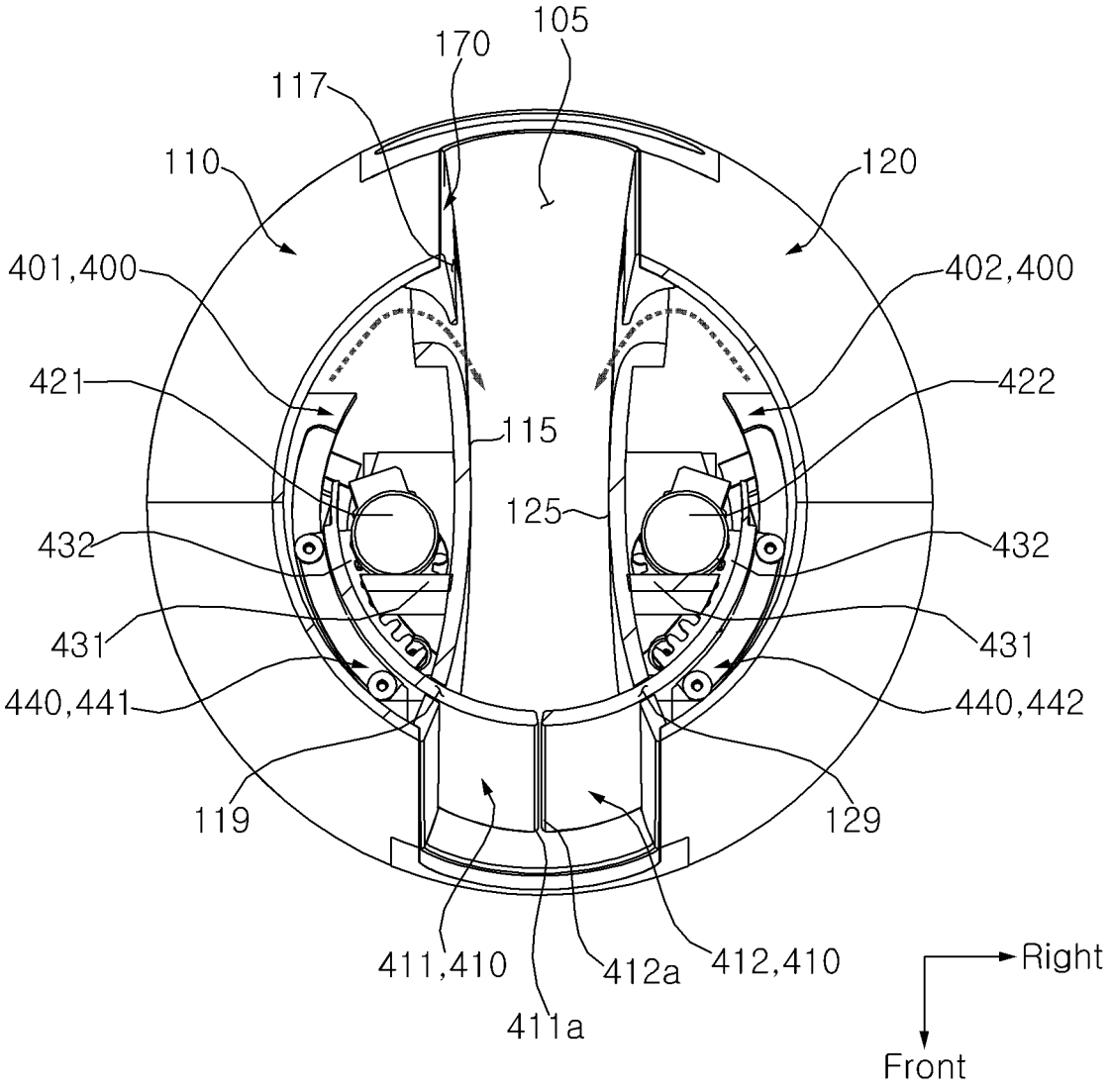
FIG. 10 is a plan view taken along line IX-IX of FIG. 3.

FIG. 10 is a horizontal cross-sectional view of an airflow converter of FIG. 2. The airflow converter 400, capable of generating an ascending airflow, will be described with reference to FIG. 7 or FIG. 16.

In this embodiment, the airflow converter 400 may convert a horizontal flow of air, flowing through the blowing space 105, into an ascending airflow.

The airflow converter 400 may include a first airflow converter 401 disposed in the first tower 110, and a second airflow converter 402 disposed in the second tower 120. The first airflow converter 401 and the second airflow converter 402 are symmetrical with each other and have the same configuration.

The airflow converter 400 may include a guide board 410 disposed in the tower and protruding into the blowing space 105, a guide motor 420 providing a driving force for moving the guide board 410, a power transmission member 430 providing the driving force of the guide motor 420 to the guide board 410, and a board guider 440 disposed inside the tower and guiding the movement of the guide board 410.

The guide board 410 may be hidden inside the tower and may protrude into the blowing space 105 when the guide motor 420 is activated.

In this embodiment, the guide board 410 includes a first guide board 411 disposed in the first tower 110, and a second guide board 412 disposed in the second tower 120.

To this end, a board slit 119 passing through the inner wall 115 of the first tower 110 and a board slit 129 passing through the inner wall 125 of the second tower 120 may be formed, respectively.

The board slit 119 formed in the first tower 110 is referred to as a first board slit 119, and the board slit formed in the second tower 120 is referred to as a second board slit 129.

The first board slit 119 and the second board slit 129 may be symmetrical with each other. The first board slit 119 and the second board slit 129 may be elongated in an up-down direction. The first board slit 119 and the second board slit 129 may be inclined with respect to a vertical direction V.

With respect to the vertical direction forming an angle of zero degrees, the front end 112 of the first tower 110 may be formed to have a first inclination and the first board slit 119 may be formed to have a second inclination. The front end 122 of the second tower 120 may also be formed to have the first inclination and the second board slit 129 may also be formed to have the second inclination.

The first inclination may range between the vertical direction and the second inclination, and the second inclination may be greater than a horizontal direction. The first inclination and the second inclination may be equal to each other, or the second inclination may be greater than the first inclination.

The guide board 410 may be formed in a flat plate or curved plate shape. The guide board 410 may be elongated in the up-down direction, and may be disposed at the front of the blowing space 105.

The guide board 410 may block the horizontal flow of air, flowing into the blowing space 105, to change the direction of airflow to an upward direction.

In this embodiment, an inner end 411*a* of the first guide board 411 and an inner end 412*a* of the second guide board 412 may come into contact with or abut on each other to form an ascending airflow. Unlike this embodiment, one guide board 410 may be in close contact with an opposite tower to form an ascending airflow.

When the airflow converter 400 is not in operation, the inner end 411*a* of the first guide board 411 may close the first board slit 119, and the inner end 412*a* of the second guide board 412 may close the second board slit 129.

When the airflow converter 400 is activated, the inner end 411*a* of the first guide board 411 may pass through the first board slit 119 to protrude into the blowing space 105, and the inner end 412*a* of the second guide board 412 may pass through the second board slit 129 to protrude into the blowing space 105.

In this embodiment, the first guide board 411 and the second guide board 412 may protrude into the blowing space 105 by rotation. Unlike this embodiment, it is also possible that at least one of the first guide board 411 and the second guide board 412 may linearly move by sliding to protrude into the blowing space 105.

When viewed from the top, the first guide board 411 and the second guide board 412 may be formed in an arc shape. Each of the first guide board 411 and the second guide board 412 may form a predetermined radius of curvature, and a center of curvature of each of the first guide board 411 and the second guide board 412 may be located in the blowing space 105.

When the guide board 410 is hidden inside the tower, a volume of the guide board 410 in a radially inward direction is preferably greater than a volume of the guide board 410 in a radially outward direction.

The guide board 410 may be made of a transparent material. A light-emitting member, such as a light-emitting diode (LED), may be disposed at the guide board 410, and light emitted by the light-emitting member may allow the entire guide board 410 to be illuminated. The light-emitting member may be disposed in the discharge passage O in the tower and may be disposed at an outer end of the guide board 410.

The guide motor 420 may include a first guide motor 421 providing torque to the first guide board 411, and a second guide motor 422 providing torque to the second guide board 412.

The first guide motor 421 may be disposed on each of an upper side and a lower side in the first tower 110, and if it is necessary to distinguish the first guide motor, the first guide motor may be divided into an upper first guide motor 421 and a lower first guide motor 421. The upper first guide motor is disposed below the upper end 111 of the first tower 110, and the lower first guide motor is disposed above the fan 320.

The second guide motor 422 may also be disposed on each of an upper side and a lower side in the second tower 120, and if it is necessary to distinguish the second guide motor, the second guide motor may be divided into an upper second guide motor 422*a* and a lower second guide motor 422*b*. The upper second guide motor is disposed below the upper end 121 of the second tower 120, and the lower second guide motor is disposed above the fan 320.

In this embodiment, rotating shafts of the first guide motor 421 and the second guide motor 422 may be disposed vertically, and a rack-pinion structure may be used to transmit a driving force.

The power transmission member 430 may include a driving gear 431 coupled to the motor shaft 312 of the guide motor 420, and a rack 432 coupled to the guide board 410.

The driving gear 431 is a pinion gear and may rotate horizontally.

The rack 42 may be coupled to an inner surface of the guide board 410. The rack 432 may be disposed in the discharge passage O, and may perform a turning motion with the guide board 410.

The board guider 440 may guide the turning motion of the guide board 410. The board guider 440 may support the guide board 410 when the guide board 410 performs the turning motion.

In this embodiment, the board guider 440 may be disposed on an opposite side of the rack 432 with respect to the guide board 410. The board guider 440 may support a force applied by the rack 432. Unlike this embodiment, it is also possible that a groove corresponding to a turning radius of the guide board may be formed in the board guider 440, and the guide board may be moved along the groove.

The board guider 440 may be assembled to the outer walls 114 and 124 of the tower. The board guider 440 may be disposed radially outward from the guide board 410, thereby minimizing contact with the air flowing through the discharge passage O.

Figure 11:
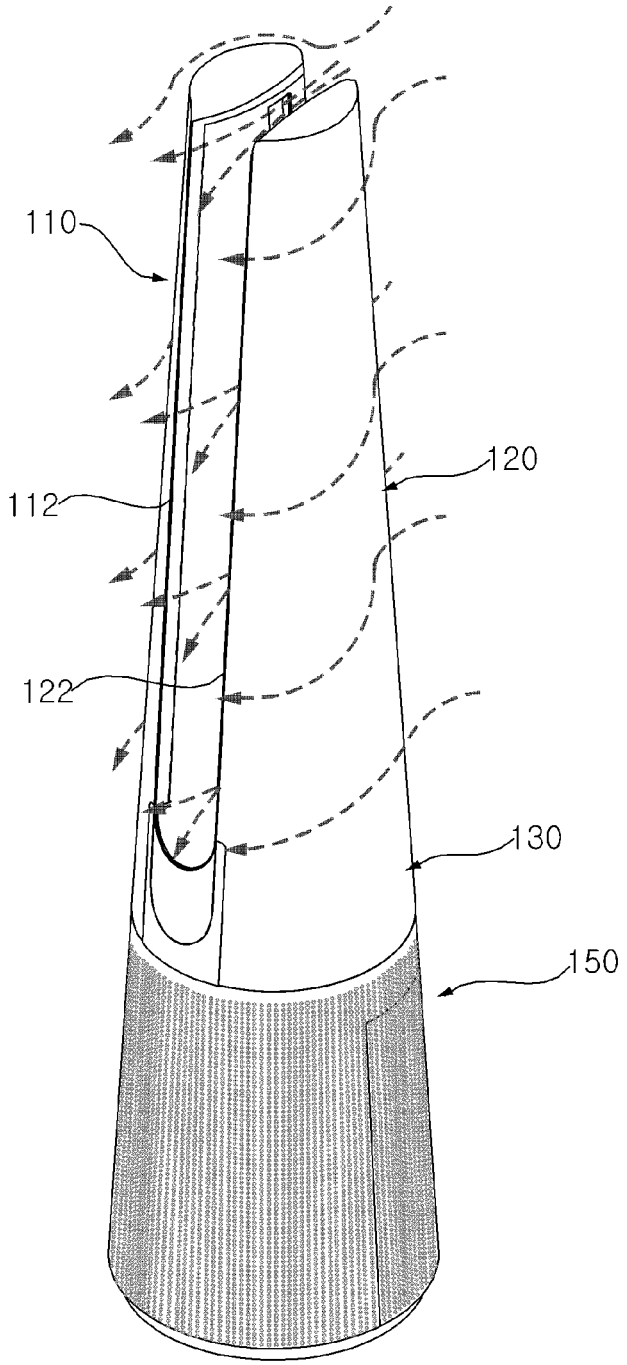
FIG. 11 is an exemplary view illustrating a horizontal airflow of a blower according to an embodiment of the present disclosure.

FIG. 11 is a diagram illustrating an example of a horizontal airflow of a blower according to an embodiment of the present disclosure.

Referring to FIG. 11, when the horizontal airflow is provided, the first guide board 411 is hidden inside the first tower 110, and the second guide board 412 is hidden inside the second tower 120.

The air discharged from the first discharge port 117 and the air discharged from the second discharge port 127 may join in the blowing spaces 105 and 120, and may pass through the front ends 112 and 122 to flow forward.

Further, the air behind the blowing space 105 may be guided into the blowing space 105, to flow forward.

In addition, the air around the first tower 110 may flow forward along the first outer wall 114, and the air around the second tower 120 may flow forward along the second outer wall 124.

The first discharge port 117 and the second discharge port 127 are elongated in the up-down direction and are symmetrical with each other, thereby uniformly distributing the air flowing along the upper side of the first discharge port 117 and the second discharge port 127 and the air flowing along the lower side thereof.

In addition, the air discharged from the first and second discharge ports 117 and 127 join in the blowing space 105, thereby improving straightness of the discharged air and allowing the air to flow a longer distance.

Figure 12:
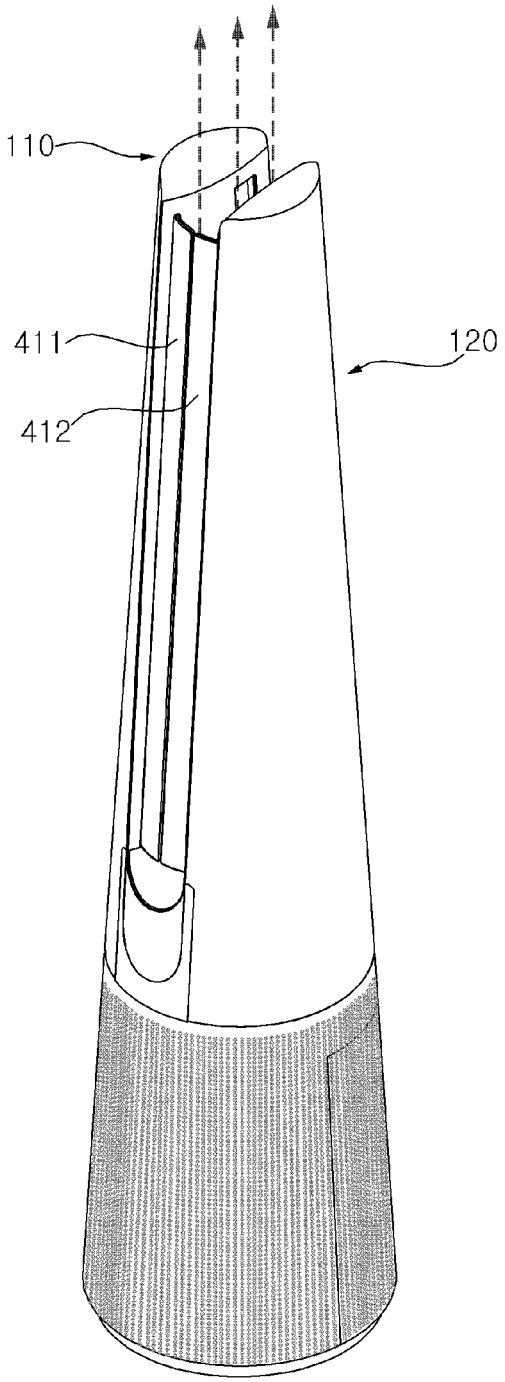
FIG. 12 is an exemplary view illustrating an ascending airflow of a blower according to an embodiment of the present disclosure.

FIG. 12 is a diagram illustrating an example of an ascending airflow of a blower according to an embodiment of the present disclosure.

Referring to FIG. 12, when an ascending airflow is provided, the first guide board 411 and the second guide board 412 protrude into the blowing space 105 and may block a front side of the blowing space 105.

As the front side of the blowing space 105 is blocked by the first guide board 411 and the second guide board 412, the air discharged from the discharge ports 117 and 127 may flow upward along the rear surfaces of the first guide board 411 and the second guide board 412 and is discharged to the top of the blowing space 105.

By forming the ascending airflow in the blower 1, it is possible to prevent the discharged air from flowing directly to the user. In addition, the indoor air may be circulated by operating the blower 1 in the ascending airflow mode.

For example, by operating the blower 1 in the ascending airflow mode when the air conditioner and the blower are used at the same time, convection of the indoor air may b e promoted, and the indoor air may be cooled or heated more quickly.

The above description of the present disclosure is provided for the purpose of illustration, and it would be understood by those skilled in the art, to which the present disclosure pertains, that various changes and modifications may be made without changing technical conception and essential features of the present disclosure. Thus, it is clear that the above-described embodiments are illustrative in all aspects and are not intended to limit the present disclosure. The scope of the present disclosure is defined by the following claims rather than by the detailed description of the embodiment. It shall be understood that all modifications and embodiments conceived from the meaning and scope of the claims and their equivalents are included in the scope of the present disclosure.

What is claimed is:

1. A blower, comprising:

a case having a suction port and discharge ports;

a fan disposed inside of the case; and a diffuser that is disposed downstream of the fan and guides air, discharged from the fan, toward the discharge ports, wherein the diffuser comprises:

an outer wall having a circumference;

an inner wall spaced apart inwardly from the outer wall so that an air passage, through which the air discharged from the fan flows, is formed therebetween; and a plurality of vanes that extends radially between the outer wall and the inner wall and divides the air passage into a plurality of unit passages, wherein the outer wall and the inner wall are formed to have areas with different radial separation distances D-between the outer wall and the inner wall, wherein the air passage comprises a normal area in which the separation distance is a predetermined value, and an extended area in which the separation distance is greater than the predetermined value, wherein a plurality of recessed portions, which is recessed radially inward, is formed in the inner wall of the extended area, and wherein the plurality of recessed portions is spaced apart from each other along a circumferential direction of the inner wall.

2. The blower of claim 1, wherein the case comprises:

a lower case having the suction port formed therein, and the fan and the diffuser disposed therein;

an upper case having the discharge ports formed therein, disposed over the lower case, and having a discharge passage disposed therein through which the air flows toward the discharge ports; and a middle case disposed between the lower case and the upper case, and having an intermediate passage to allow the air passage to communicate with the discharge passage.

3. The blower of claim 2, further comprising a penetrating member having at least a portion that penetrates into the middle case and disposed in the intermediate passage, wherein the separation distance in a first area is larger than in an area adjacent to the first area in the air passage of the diffuser, the first area being defined as a projected area in which the penetrating member is projected to the air passage of the diffuser.

4. The blower of claim 2, wherein the upper case comprises:

a first discharge case having a first discharge port and a first discharge passage through which the air flows toward the first discharge port; and a second discharge case having a second discharge port and a second discharge passage through which the air flows toward the second discharge port, the second discharge case being spaced apart from the first discharge case such that a space is formed therebetween, wherein each of the first discharge passage and the second discharge passage communicates with the intermediate passage of the middle case, and wherein the separation distance in at least a portion of a second area is formed to be larger than in an area adjacent to the second area in the air passage of the diffuser, the second area being defined as an area in which the first discharge passage and the second discharge passage are projected to the air passage.

5. The blower of claim 4, wherein the first discharge case and the second discharge case are symmetrical to each other with respect to the space formed therebetween, and wherein distribution of the separation distance is symmetrical with respect to a third area, which is an area in which the space is projected to the air passage.

6. The blower of claim 1, wherein the blower further comprises:

a first tower disposed above the diffuser, having a first discharge port of the discharge ports, and elongated upward;

a second tower disposed above the diffuser, having a second discharge port of the discharge ports, elongated upward, and laterally spaced apart from the first tower such that a space is formed therebetween;

a bridge surface that connects lower ends of side walls of the first tower and the second tower which face each other with respect to the space; and a supporter having a lower portion connected to an upper end of an inner wall and an upper portion connected to a lower side of the bridge surface, so as to transfer load from the bridge surface to the inner wall, wherein the plurality of vanes have radially inner ends connected to the inner wall and radially outer ends connected to the outer wall.

7. The blower of claim 6, wherein the diffuser further comprises at least one sub-column disposed within the inner wall, disposed on a same circumference as the plurality of recessed portions with respect to a center of the inner wall, and having an upper end connected to the lower portion of the supporter.

8. The blower of claim 1, wherein the plurality of vanes is equally spaced apart around the circumference.

9. The blower of claim 1, wherein a separation distance between adjacent vanes of the plurality of vanes is larger in the extended area than in the normal area.

10. The blower of claim 9, wherein a plurality of grooves is formed circumferentially in an inner surface of the outer wall and an outer surface of the inner wall, and wherein:

adjacent grooves among the plurality of grooves are equally spaced apart; and the plurality of vanes are press-fit into predetermined grooves of the plurality of grooves, to be fastened thereto.

11. The blower of claim 1, wherein the inner wall has a bent portion pressed radially inward in the extended area.

12. The blower of claim 11, wherein the bent portion is a curved surface that is convex inward.

13. A blower, comprising:

a case having a suction port and discharge ports;

a fan disposed inside of the case; and a diffuser that is disposed downstream of the fan and guides air, discharged from the fan, toward the discharge ports, wherein the diffuser comprises:

an outer wall having a circumference;

an inner wall spaced apart inwardly from the outer wall so that an air passage, through which the air discharged from the fan flows, is formed therebetween; and a plurality of vanes that extends radially between the outer wall and the inner wall and divides the air passage into a plurality of unit passages, wherein the outer wall and the inner wall are formed to have areas with different radial separation distances between the outer wall and the inner wall, wherein the air passage comprises a normal area in which the separation distance is a predetermined value, and an extended area in which the separation distance is greater than the predetermined value, and wherein the inner wall has at least one bent portion pressed radially inward in the extended area.

14. The blower of claim 13, wherein the case comprises:

a lower case having the suction port formed therein, and the fan and the diffuser disposed therein;

an upper case having the discharge ports formed therein, disposed over the lower case, and having a discharge passage disposed therein through which the air flows toward the discharge ports; and a middle case disposed between the lower case and the upper case, and having an intermediate passage to allow the air passage to communicate with the discharge passage.

15. The blower of claim 13, wherein the blower further comprises:

a first tower disposed above the diffuser, having a first discharge port of the discharge ports, and elongated upward;

a second tower disposed above the diffuser, having a second discharge port of the discharge ports, elongated upward, and laterally spaced apart from the first tower such that a space is formed therebetween;

a bridge surface that connects lower ends of side walls of the first tower and the second tower which face each other with respect to the space; and a supporter having a lower portion connected to an upper end of an inner wall and an upper portion connected to a lower side of the bridge surface, so as to transfer load from the bridge surface to the inner wall, wherein the plurality of vanes have radially inner ends connected to the inner wall and radially outer ends connected to the outer wall.

16. The blower of claim 13, wherein a separation distance between adjacent vanes of the plurality of vanes is larger in the extended area than in the normal area.

17. A blower, comprising:

a case having a suction port and discharge ports;

a fan disposed inside of the case; and a diffuser that is disposed downstream of the fan and guides air, discharged from the fan, toward the discharge ports, wherein the diffuser comprises:

an outer wall having a circumference;

an inner wall spaced apart inwardly from the outer wall so that an air passage, through which the air discharged from the fan flows, is formed therebetween;

a plurality of vanes that extends radially between the outer wall and the inner wall and divides the air passage into a plurality of unit passages, wherein the outer wall and the inner wall are formed to have areas with different radial separation distances between the outer wall and the inner wall, wherein the air passage comprises a normal area in which the separation distance is a predetermined value, and an extended area in which the separation distance is greater than the predetermined value; and at least one sub-column disposed within the inner wall and having an upper end connected to a lower portion of a supporter.

18. The blower of claim 17, wherein the case comprises:

a lower case having the suction port formed therein, and the fan and the diffuser disposed therein;

an upper case having the discharge ports formed therein, disposed over the lower case, and having a discharge passage disposed therein through which the air flows toward the discharge ports; and a middle case disposed between the lower case and the upper case, and having an intermediate passage to allow the air passage to communicate with the discharge passage.

19. The blower of claim 17, wherein the blower further comprises:

a first tower disposed above the diffuser, having a first discharge port of the discharge ports, and elongated upward;

a second tower disposed above the diffuser, having a second discharge port of the discharge ports, elongated upward, and laterally spaced apart from the first tower such that a space is formed therebetween;

a bridge surface that connects lower ends of side walls of the first tower and the second tower which face each other with respect to the space; and the supporter having the lower portion of which is connected to the upper end of the inner wall and an upper portion of which is connected to a lower side of the bridge surface, so as to transfer load from the bridge surface to the inner wall, wherein the plurality of vanes have radially inner ends connected to the inner wall and radially outer ends connected to the outer wall.

20. The blower of claim 17, wherein a separation distance between adjacent vanes of the plurality of vanes is larger in the extended area than in the normal area.

* * * * *